United States Patent [19]

Mears et al.

[11] 4,071,461

[45] Jan. 31, 1978

[54] GASEOUS DIELECTRIC MIXTURES FOR SUPPRESSING CARBON FORMATION

[75] Inventors: Whitney H. Mears, Buffalo; Sabatino R. Orfeo, Orchard Park, both of N.Y.

[73] Assignee: Allied Chemical Corporation, Morris Township, N.J.

[21] Appl. No.: 709,343

[22] Filed: July 28, 1976

Related U.S. Application Data

[63] Continuation-in-part of Ser. No. 589,496, June 23, 1975, abandoned.

[51] Int. Cl.[2] ..... H01B 3/56

[52] U.S. Cl. ..... 252/63.5; 174/17 GF; 174/DIG. 1; 200/148 G; 252/65; 252/66

[58] Field of Search ..... 252/65, 66, 63, 63.5; 174/17 GF, DIG. 1; 200/148 G

[56] References Cited

U.S. PATENT DOCUMENTS

| | | | |
|---|---|---|---|
| 2,173,717 | 9/1939 | Hobart | 174/17 GF X |
| 2,957,938 | 10/1960 | Camilli et al. | 200/148 G X |
| 3,059,044 | 10/1962 | Friedrich et al. | 174/18 |
| 3,150,245 | 9/1964 | Leeds et al. | 200/148 G X |
| 3,184,533 | 5/1965 | Elseman | 252/63.5 X |
| 3,281,521 | 10/1966 | Wilson | 174/17 GF |

*Primary Examiner*—Harris A. Pitlick
*Attorney, Agent, or Firm*—David W. Collins; Jay P. Friedenson

[57] ABSTRACT

Carbon formation on voltage breakdown and sparking, and consequent carbon deposits on insulators and other surfaces, is suppressed in dielectric gases of halogenated alkanes by adding $SF_6$ and/or $CO_2$ to the halogenated alkane to form a gaseous dielectric mixture. Moreover, certain of the gaseous dielectric mixtures evidence unexpectedly high dielectric breakdown voltages. The gaseous dielectric mixtures are useful in high voltage coaxial lines, in transformers, in minisubstations, and the like.

29 Claims, 10 Drawing Figures

GASEOUS DIELECTRIC MIXTURES FOR SUPPRESSING CARBON FORMATION

This is a continuation-in-part of application Ser. No. 589,496, filed June 23, 1975, and now abandoned.

BACKGROUND OF THE INVENTION

I. Field of the Invention

This invention relates to a process for the production of dielectric mixtures, useful for preventing or diminishing the formation of carbon in dielectric fluids during electrical discharges therein.

II. Description of the Prior Art

During the operation of electrical equipment, such as switches, circuit breakers, transformers, and the like, arcing, sparking or glow discharges usually or occasionally occur, especially at higher voltages. Dielectric materials are commonly employed to reduce or prevent the possibility of such arcing, sparking and glow discharges. For example, solid insulators, such as ceramics or resins, may be used to support or surround electrical conductors. Or, fluid dielectric materials, such as oils or gases, may be used to insulate electrical conductors.

A related problem involves the breakdown of carbon-containing dielectric materials. During arcing, these materials tend to decompose and form carbon, a non-volatile solid, which, being an electrical conductor, not only shortens the gap between conductors, but also eventually leads to carbon bridge short circuits, or deposited carbon tracks. This is a serious problem which has plagued the electrical industry for years.

As used herein, arc interruption includes arc suppression and arc quenching, and refers to preventing or reducing arcing between electrodes. Carbon formation suppression refers to preventing the formation of carbon during arcing. Suppression of carbon formation also prevents formation of conducting carbon tracks or deposits of non-volatile carbon on insulating surfaces. Such deposits are known to produce regions of non-uniform electric fields which result in a decrease in the dielectric strength of the system.

Sulfur hexafluoride ($SF_6$) is well-known as an excellent gaseous dielectric. See, e.g., U.S. Pat. No. 3,059,044, issued to R. E. Friedrich et al., Oct. 16, 1962. It is unique in its electric arc interrupting properties. However, $SF_6$ does have a few inherent limitations: low vapor pressure at low temperatures, comparatively high freezing point (−50.6° C) and relatively high cost.

For some years, it has been known that certain electronegatively substituted carbon compounds (halogenated alkanes) are also highly useful fluid insulators in electrical apparatus. Typical examples are dichlorodifluoromethane ($CCl_2F_2$), octafluorocyclobutane (c-$C_4F_8$), hexafluoroethane ($C_2F_6$), octafluoropropane ($C_3F_8$), decafluorobutane ($C_4F_{10}$), trichlorofluoromethane ($CCl_3F$), sym-dichlorotetrafluoroethane ($CClF_2CClF_2$), chloropentafluoroethane ($CClF_2CF_3$) and chlorotrifluoromethane ($CClF_3$). While all of the above have reasonably good dielectric strengths, it is difficult to prevent spark-over or other electrical discharge from occurring in apparatus containing these materials when high voltage surges develop. The spark-over or other discharge typically leads to carbon formation.

A patent issued to J. A. Manion, et al., U.S. Pat. No. 3,650,955, issued Dec. 9, 1966, teaches the use of $CCl_2F_2$ combined with c-$C_4F_8$ as an arc interrupter gas.

However, this combination has been observed to evidence extensive carbon formation properties.

Mixtures of $SF_6$ and $CO_2$ have been suggested as a potential gaseous dielectric medium. See, e.g., U.S. Pat. No. 3,059,044, issued to R. E. Friedrich et al., Oct. 16, 1962. However, the patent fails to disclose specific proportions of the components.

Mixtures of insulating gases have been previously disclosed; see, e.g., U.S. Pat. No. 2,173,717, issued Sept. 19, 1939, which discloses mixtures of a gas such as nitrogen or carbon dioxide with other materials such as $CCl_2F_2$, and U.S. Pat. No. 3,281,521, issued Oct. 25, 1966, which discloses mixtures of nitrogen, $CCl_2F_2$ and $SF_6$. However, there is no disclosure or suggestion in these patents as to whether carbon formation, which is well-known to occur when carbon-containing gases are exposed to arcing or corona conditions, can be suppressed.

Perhalogenated fluids, including $SF_6$ and perhalogenated alkanes, have been absorbed on molecular sieves (zeolites), which are then incorporated as fillers in organic insulators; see U.S. Pat. No. 3,305,656, issued to J. C. Devins, Feb. 21, 1967. During high voltage operation, voids in the insulation are filled by the perhalogenated fluid, which then serves as an arc interrupter.

Attempts have been made to develop gaseous dielectric compositions as carbon formation suppressants. For example, B. J. Eiseman, U.S. Pat. No. 3,184,533, issued May 18, 1965, teaches the use of an oxygen-containing oxidizing agent, such as $SO_2$, $N_2O$ and NO, to suppress carbon tracing of certain electro-negatively substituted carbon compounds, such as saturated polyhalohydrocarbon compounds, saturated perhalohydrocarbon compounds, saturated perfluoroethers and the like. However, none of these oxidizing agents is desirable because of their corrosive nature, toxicity, and/or chemical reactivity.

In general, any attempts to suppress carbon formation in carbon-containing dielectric gases exposed to arcing or corona conditions by use of a diluent gas requires a high percentage of the diluent gas. Since the well-known diluent gases of nitrogen, carbon tetrafluoride and the like usually have a low dielectric strength, then any gaseous dielectric mixtures employing these diluent gases will consequently have a dielectric strength intermediate the dielectric gas and the diluent gas.

There remains in the art a need for an efficient gaseous dielectric composition that evidences superior carbon suppression properties.

SUMMARY OF THE INVENTION

In accordance with the invention, carbon formation in a dielectric fluid during an electrical discharge from an electrical conductor is suppressed by contacting the electrical conductor during operation with a gaseous dielectric mixture consisting essentially of at least one halogenated alkane plus one member selected from the group consisting of $SF_6$, in an amount of at least 10 mole percent, $CO_2$, in an amount of at least 15 mole percent, and a combination of $SF_6$ and $CO_2$ which, when plotted on a ternary diagram in mole percent of $SF_6$-$CO_2$-halogenated alkane, lies in regions rich in $SF_6$ and $CO_2$ defined by a line having at its extremities the points defined by 1 $SF_6$ - 15 $CO_2$ - 84 halogenated alkane 10 $SF_6$ - 1 $CO_2$ - 89 halogenated alkane Use of $SF_6$ and/or $CO_2$ in accordance with the invention permits use of a higher concentration of carbon-containing compounds (halogenated alkanes) than heretofore possible, without formation of carbon resulting from exposure of the gaseous dielectric mixture to arcing and corona conditions. The higher concentration of halogenated alkanes in the mixture permits retention of higher dielectric strengths than otherwise possible.

Halogenated alkanes useful in the practice of the invention are those which contain from 1 to 4 carbon atoms and at most one hydrogen atom, with the remaining hydrogen atoms replaced by at least one halogen selected from the group consisting of fluorine, chlorine or bromine. The halogenated alkanes desirably have a vapor pressure of at least about 100 Torr at 20° C. These compounds are gaseous under operating conditions.

The amount of $SF_6$ and/or $CO_2$ required to suppress carbon formation is unique to each mixture. In general, however, for a binary mixture and for multicomponent mixtures containing either $SF_6$ or $CO_2$, gaseous mixtures containing at least about 10 mole percent of $SF_6$ or at least about 15 mole percent of $CO_2$ are required to suppress carbon formation. For multicomponent mixtures (ternary and higher) containing both $SF_6$ and $CO_2$, carbon formation is suppressed for compositions lying in regions rich in $SF_6$ and $CO_2$ on a ternary diagram defined by a line having at its extremities the points defined by 1 $SF_6$ - 15 $CO_2$ - 84 halogenated alkane
10 $SF_6$ - 1 $CO_2$ - 89 halogenated alkane (the numbers are in mole percent).

Certain of these mixtures form novel compositions. Such novel compositions consist essentially of at least one halogenated alkane plus $SF_6$ and $CO_2$. The halogenated alkanes contain from 1 to 4 carbon atoms and at most one hydrogen atom, with the remaining hydrogen atoms replaced by at least one halogen selected from the group consisting of fluorine, chlorine and bromine. The halogenated alkanes desirably have a vapor pressure of at least about 100 Torr at 20° C. The amount of $SF_6$ and $CO_2$ in the compositions is as given above.

Further in accordance with the invention, improved dielectric breakdown voltages that are unexpectedly high are obtained by employing specific gaseous dielectric mixtures within the scope of this invention in certain critical proportions set forth below.

DETAILED DESCRIPTION OF THE INVENTION

Figure 1:
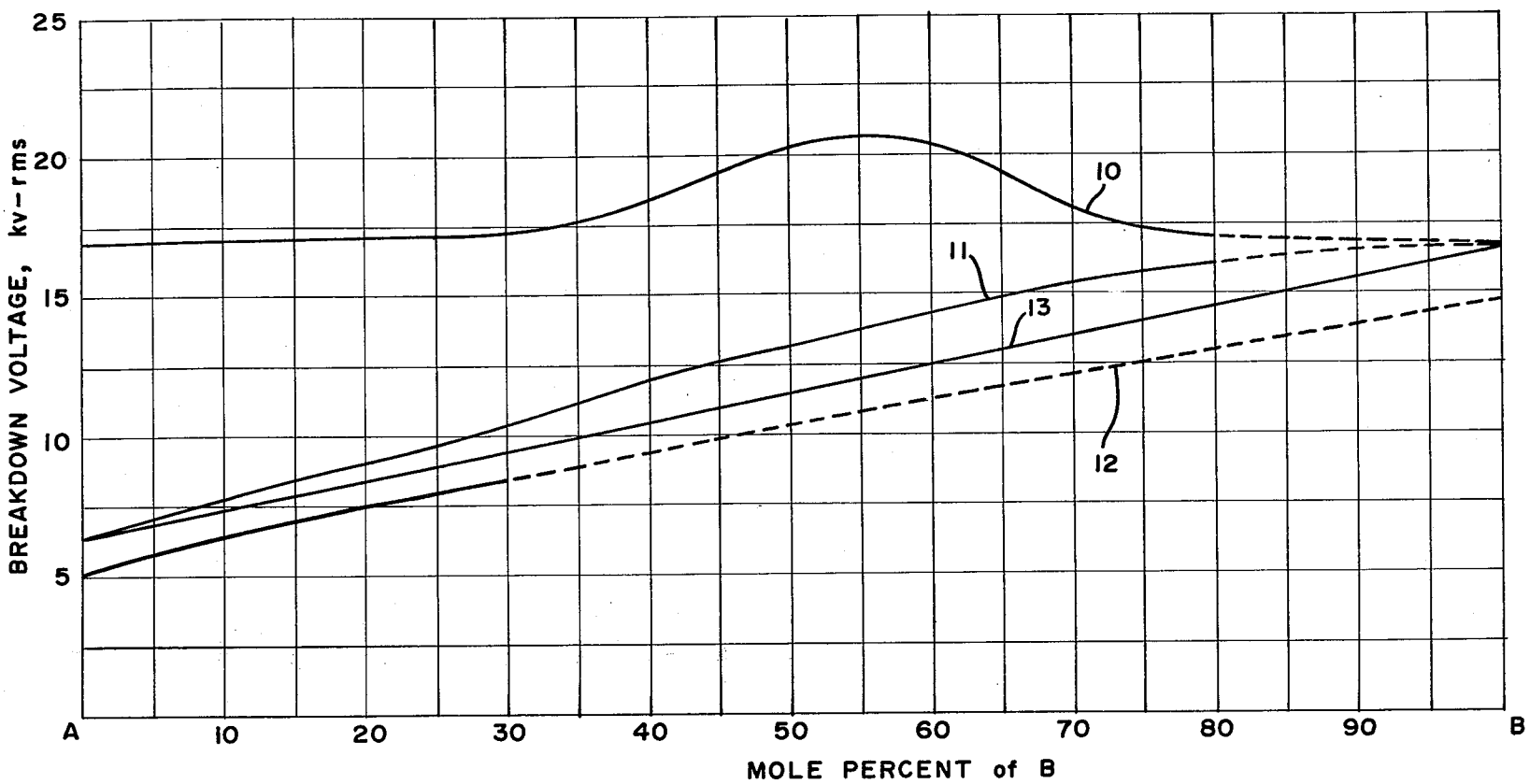
FIG. 1, on coordinates of breakdown voltage in kv-rms and concentration in mole percent, is a plot in a binary system A-B of the dielectric strength of various mixtures of components A and B.

Dielectric carbon-containing gases decompose under arcing or corona conditions to form carbon deposits. Diluent gases are often combined with the dielectric carbon-containing gases to suppress the carbon formation. However, the mixture of diluent gas and dielectric carbon-containing gas has a low dielectric strength, because the diluent gases, usually nitrogen or the very arc-stable carbon tetrafluoride, themselves have low dielectric strengths, and large quantities of the diluent gases are required in order to suppress carbon formation.

In accordance with the invention, carbon formation suppression in a dielectric fluid during an electrical discharge from an electrical conductor is suppressed by contacting the electric conductor during operation with a gaseous dielectric mixture consisting essentially of at least one halogenated alkane plus one member selected from the group consisting of $SF_6$, in an amount of at least 10 mole percent, $CO_2$, in an amount of at least 15 mole percent, and a combination of $SF_6$ and $CO_2$ which, when plotted on a ternary diagram in mole percent of $SF_6$-$CO_2$-halogenated alkane, lies in regions rich in $SF_6$ and $CO_2$ defined by a line having at its extremities the points defined by 1 $SF_6$ - 15 $CO_2$ - 84 halogenated alkane
10 $SF_6$ - 1 $CO_2$ - 89 halogenated alkane.

The dielectric mixtures of the invention permit the retention of the high dielectric strengths associated with the halogenated alkanes, since less suppressant gas ($SF_6$ and/or $CO_2$) is needed to suppress carbon formation, as compared with prior art diluent gases. Further, the presence of the suppressant gases of $SF_6$ and $CO_2$ apparently serves to saturate any free valences of stripped carbon atoms resulting from the decomposition of the carbon-containing gas by supplying either fluorine atoms (from $SF_6$) or oxygen atoms (from $CO_2$), thus preventing the formation of carbon-carbon bonds which would otherwise result in formation of non-volatile carbon deposits on solid surfaces.

Halogenated alkanes useful in the practice of the invention are those which contain from 1 to 4 carbon atoms, since compounds with a greater number of carbon atoms tend to possess undesirably low vapor pressures at desired operating temperatures.

The halogenated alkanes contain at most one hydrogen atom, with the remaining hydrogen atoms replaced by at least one halogen selected from the group consisting of fluorine, chlorine and bromine. More than one hydrogen atom per molecule results in excessive carbon formation.

The halogenated alkanes desirably have a vapor pressure of at least about 100 Torr at 20° C. The vapor pressure limitation permits the use of certain halogenated alkanes, such as 1,1,2-trichloro-1,2,2-trifluoroethane ($CCl_2FCClF_2$), which are liquid at room temperature but which evidence a sufficiently high vapor pressure to be useful over a limited range of composition. Preferably, the halogenated alkanes have a vapor pressure of at least about 400 Torr at 20° C, and most preferably, are totally gaseous (760 Torr) at room temperature and have a boiling point of less than about 5° C.

Examples of halogenated alkanes useful in the practice of the invention include chlorodifluoromethane ($CHClF_2$), bromotrifluoromethane ($CBrF_3$), hexafluoroethane ($CF_3CF_3$) and cyclooctafluorobutane (c-$C_4F_8$).

Unexpectedly, in many of these systems, improved breakdown voltage characteristics that are unusually high are obtained by employing specific gaseous dielectric mixtures of this invention within certain critical proportions set forth in examples below. Preferably, perhalogenated alkanes find use in applications such as high dielectric strength mixtures. Perhalogenated compounds are totally halogenated and include no hydrogen. Examples includes chlorotrifluoromethane ($CClF_3$), 1,2-dichloro-1,1,2,2-tetrafluoroethane ($CClF_2CClF_2$), and chloropentafluoroethane ($CClF_2CF_3$).

All compositions disclosed herein have utility as gaseous dielectric mixtures for carbon formation suppression. As such, they have application in electrical apparatus, especially high voltage power equipment, such as transformers, capacitors, coaxial lines and minisubstations, having a chamber in which electrical arcing occasionally occurs and which includes the gaseous dielectric mixture. Some of the mixtures are particularly useful in certain specific areas, such as for extreme temperature conditions, when high dielectric strength is required, which are indicated in examples set forth below.

I. Binary Compositions

Binary compositions consist essentially of mixtures of two components, A and B, where A is one member selected from the group consisting of halogenated alkanes and B is one member selected from the group consisting of $SF_6$ and $CO_2$. Examples of binary systems preferred as carbon formation suppressants include $SF_6$-$CCl_2F_2$, $SF_6$-$CHClF_2$, $SF_6$-$CClF_2CClF_2$, $SF_6$-$CClF_3$, $SF_6$-$CClF_2CF_3$, $CO_2$-$CCl_2F_2$ and $CO_2$-$CHClF_2$. While each mixture evidences a unique useful range for carbon formation suppression, in general, at least about 10 mole percent of $SF_6$ or at least about 15 mole percent of $CO_2$ is required to obtain suppression. Many mixtures may require somewhat more $SF_6$ or $CO_2$. Such a determination is easily within the ability of one skilled in the art, however, and in the Examples section below, details are set forth for determining optimum composition ranges and preferred examples are given; see also Table I below.

Gaseous dielectric mixtures which have a low tendency to form carbon when subjected to repeated electrical sparking (breakdown) are desired for use as carbon formation suppression. This objective is attained by the addition of $SF_6$ or $CO_2$ diluent to halogenated alkanes in proper quantities.

Table I summarizes the data developed for binary systems which include $SF_6$ or $CO_2$. In Table I are the results of tests of various diluent compounds with potential carbon formation suppression capability, i.e., $SF_6$, $CO_2$, $SO_2$, NO and air. The number listed in Table I in mole percent (suppression value), is the minimum quantity of the diluent component which will prevent carbon formation under the conditions of the tests described in Example 2 below. The stable inert gases, $CF_4$ and $N_2$, which also appear in Table I, serve as both diluents and blanks. Inspecting Table I, it is evident that by comparing the suppression values of $SF_6$ and $CO_2$ (and others) with those of $N_2$ and $CF_4$, the effectiveness of carbon suppression gases and the tendency of various gaseous dielectrics to form carbon can be evaluated. In cases where carbon suppression is most effective, inert diluents generally require a minimum of about 50 to 70 mole percent concentration to suppress carbon formation, compared with a minimum of about 10 to 40 mole percent concentration for suppression of carbon by the diluent-suppressants of the invention. The amount of diluent ($SF_6$ or $CO_2$) needed for carbon suppression varies, depending upon the particular halogenated alkane.

TABLE I

| CARBON FORMATION CONDITIONS BINARY SYSTEMS | | | | | | | |
|---|---|---|---|---|---|---|---|
| Compound | $SF_6$ | $CO_2$ | $N_2$ | $CF_4$ | $SO_2$ | NO | Air |
| $CClF_3$ | 10 | — | — | — | — | — | — |
| $CBrF_3$ | 10 | 15 | 20 | 10 | — | — | — |
| $CCl_2F_2$ | 10 | 15 | 50 | 50 | — | — | — |
| $CCl_3F$ | 30 | — | — | — | — | — | — |
| $CHClF_2$ | 35 | 45 | 75 | 75 | — | — | — |
| $CHF_3$ | 10 | 15 | 50 | 50 | — | — | — |
| $CF_3CF_3$ | 20 | 35 | 30 | 25 | — | — | — |
| $CClF_2CF_3$ | 25 | 25 | 50 | 70 | — | — | — |
| $CClF_2CClF_2$ | 45 | 45 | 70 | 70 | — | — | — |
| c-$C_4F_8$ | 35 | 55 | 70 | 75 | 20 | 20 | 40 |

From Table I, it is apparent that $SF_6$ and $CO_2$ are most effective suppressants with $CClF_3$, $CBrF_3$, $CCl_2F_2$ and $CHF_3$. Somewhat more suppressant is required for $CF_3CF_3$ and $CClF_2CF_3$ and even more suppressant is required for $CCl_3F$, $CHClF_2$, c-$C_4F_8$ and $CClF_2CClF_2$. In general, less diluent is required to suppress carbon formation when $SF_6$ or $CO_2$ is employed than when $N_2$ or $CF_4$ is employed. With c-$C_4F_8$, it is possible to compare the effectiveness of $SF_6$ and $CO_2$ with the suppressant gases of $SO_2$ and NO of U.S. Pat. 3,184,533 and with air. The accuracy of suppression values is ± 5 percent. Thus, $SF_6$ is only somewhat less effective than NO or $SO_2$. Carbon dioxide has about the same effect as air.

However, sulfur dioxide ($SO_2$) is a toxic, corrosive gas and is thus undesirable in a practical system. Nitric oxide (NO), also toxic and corrosive, is chemically unstable. Nitrous oxide ($N_2O$), also chemically unstable, is an anesthetic. Air is undesirable since it tends to attack equipment components such as metals and plastics, particularly at the usual operating range of 120° to 250° C.

Without subscribing to any particular theory, it is possible that since $SF_6$ is an inert diluent up to about 200° C, and $CO_2$ is an inert diluent up to about 300° C, their action in carbon suppression is probably the formation of fluorine or oxygen atoms under arc conditions. These atoms then subsequently react with the carbon-containing fragments of the arced halogenated alkanes, thereby forming non-conducting decomposition products rather than electrically conducting carbon.

Since halogenated alkanes vary in their carbon formation tendencies, the desired composition ranges are conveniently based upon the carbon suppression values of Table I. That is, for $SF_6$ mixtures, the broad range of compositions useful as dielectric gases varies from the minimum diluent necessary to suppress carbon formation up to about 99 mole percent of $SF_6$. For $CO_2$ mixtures, compositions having a breakdown voltage of greater than about 10 kv-rms (kilovolt-root mean square) are considered useful, except in certain special applications. Generally, compositions containing at least the minimum amount of $CO_2$ necessary to suppress carbon formation, but less than about 65 to 80 mole percent of $CO_2$, depending on the particular gaseous mixture, are considered useful.

Of course, operating at voltages considerably less than the breakdown voltage at which carbon formation appears would permit use of a somewhat broader range of compositions. Preferred compositions are those that retain about 90% of the breakdown voltage of the higher of the two components.

Within the broad range disclosed above, many mixtures of halogenated alkanes with $SF_6$ and with $CO_2$ evidence an unexpected enhancement of dielectric strength, as measured by breakdown voltage, using a standard cell as described by ASTM D2477-66T. Examples of such systems include $SF_6$-$CCl_2F_2$, $SF_6$-$CBrF_3$ and and $CO_2$-$CBrF_3$. It would be expected that for most binary compositions, breakdown voltage would vary linearly with composition. However, for some compositions, an unexpected enhancement of breakdown voltage is observed. This may take the form either of a moderate positive deviation from linearity or of a significant positive deviation from linearity to the extent that over some range of composition, the observed breakdown voltage is equal to or greater than that of either of the two end members. The latter condition is referred to herein as a synergistic effect. It is not possible to indicate general composition ranges. However, such a determination for a specific system is easily within the ability of one skilled in the art. The Examples section sets forth further details and lists preferred examples; see also Tables IV and V, below.

An example of both carbon formation suppression and improved dielectric strength in accordance with the invention is shown in FIG. 1, which is a plot of breakdown voltage in kv-rms as a function of composition in mole percent for a binary system of components A and B. Carbon formation appears over the range indicated by the dotted portions of the curves. In this example, component B is chloropentafluoroethane ($CClF_2CF_3$). Component A is variously $SF_6$ (curve 10); $CO_2$(curve 11); and $CF_4$ (curve 12). Where component A is $SF_6$ (curve 10), there is not only a positive deviation from linearity (cf. line 13), but an actual enhancement such that the mixture over a range of composition evidences a breakdown voltage greater than that of either of the two end members. Where component A is $CO_2$ (curve 11), there is a positive deviation from linearity. Where component A is $CF_4$ (curve 12), both extensive carbon formation and little deviation from linearity are observed. Line 13 depicts the expected linear behavior of breakdown voltage with composition variation. Such results for binary mixtures are typical of many of the mixtures of halogenated alkanes with $SF_6$ and $CO_2$ disclosed herein. Such mixtures tend to exhibit both low carbon formation and ehnhanced breakdown voltage characteristics.

Figure 2:
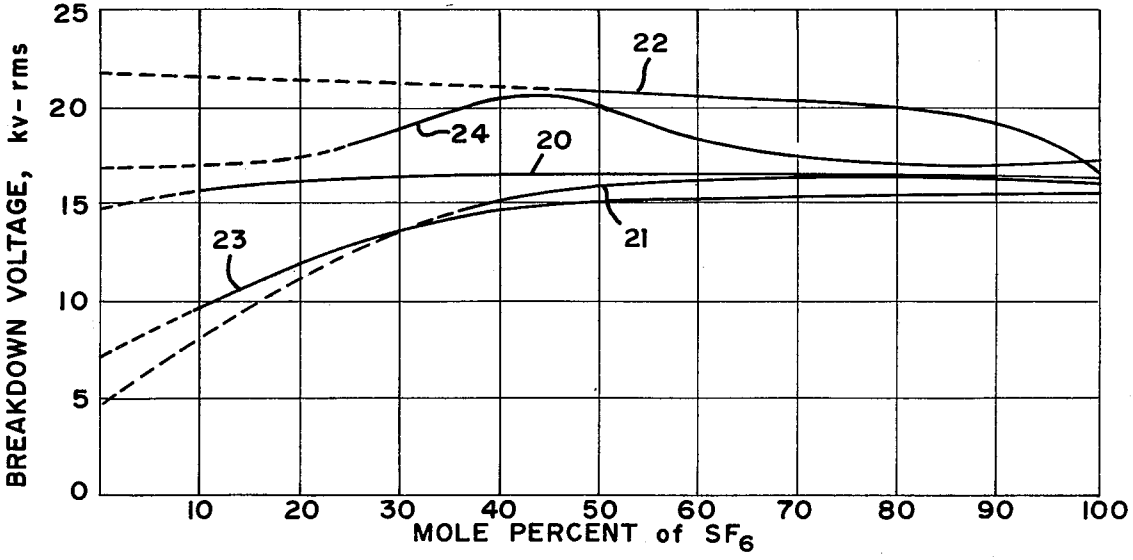
FIG. 2, on coordinates of breakdown voltage in kv-rms and concentration in mole percent, is a plot of various binary mixtures with $SF_6$.
Figure 3:
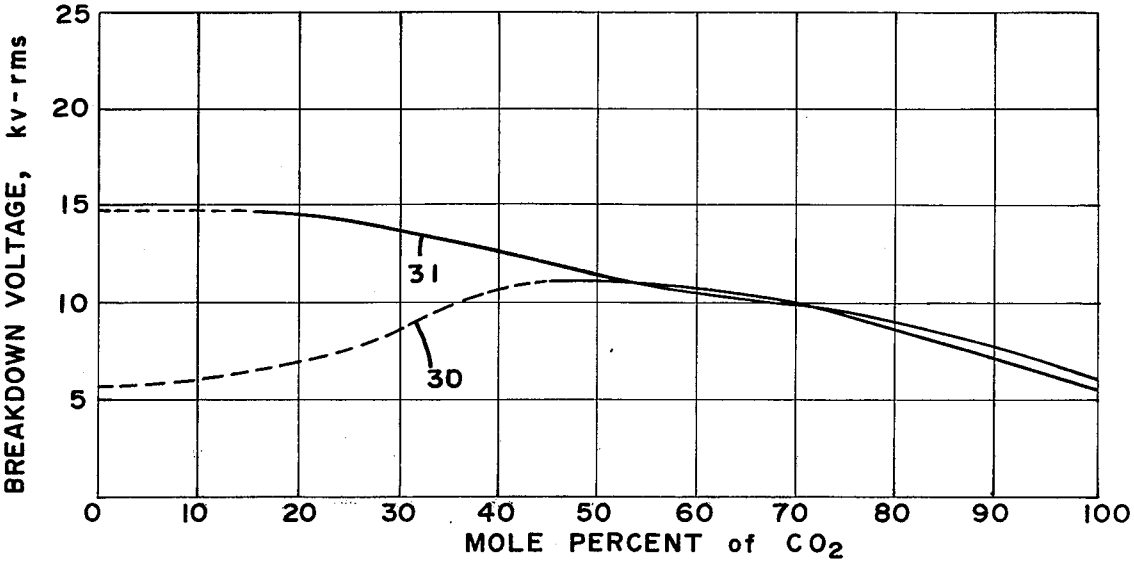
FIG. 3, on coordinates of breakdown voltage in kv-rms and concentration in mole percent, is a plot of various binary mixtures with $CO_2$.

FIGS. 2 and 3 depict preferred binary systems with $SF_6$ and $CO_2$, respectively. In FIG. 2, the following curves represent the breakdown voltages of the listed compositions with $SF_6$: curve 20, dichlorodifluoromethane ($CCl_2F_2$); curve 21, chlorodifluoromethane ($CHClF_2$); curve 22, 1,2-dichloro-1,1,2,2-tetrafluoroethane ($CClF_2CClF_2$); curve 23, chlorotrifluoromethane ($CClF_3$); and curve 24, chloropentafluoroethane ($CClF_2CF_3$). In FIG. 3, the following curves represent the breakdown voltages of the listed compositions with $CO_2$: curve 30, $CHClF_2$ and curve 31, $CCl_2F_2$.

II. Multi-Component Compositions

Ternary compositions consist essentially of mixtures of three compounds, A, B and C, at least one of which is selected from the group consisting of halogenated alkanes and at least one of which is selected from the group consisting of $SF_6$ and $CO_2$. Examples of ternary systems preferred as carbon formation suppressants include $SF_6$-$CO_2$-$CCl_2F_2$, $SF_6$-$CO_2$-$CHClF_2$, $SF_6$-$CO_2$-$CClF_2CClF_2$, $SF_6$-$CO_2$-$CClF_2CF_3$, $SF_6$-$CO_2$-$CBrF_3$, $SF_6$-$CClF_3$-$CHF_3$, $CO_2$-$CCl_2F_2$-$CHClF_2$ and $CO_2$-$CF_3CF_3$-c-$C_4F_8$. While each mixture evidences a unique useful range for carbon formation suppression, in general, for multicomponent mixtures containing either $SF_6$ or $CO_2$, gaseous mixtures containing at least about 10 mole percent of $SF_6$ or at least about 15 mole percent of $CO_2$ are required to suppress carbon formation. For multicomponent mixtures containing both $SF_6$ and $CO_2$, carbon formation is suppressed for compositions lying in regions rich in $SF_6$ and $CO_2$ on a ternary diagram defined by a line having at its extremities the points defined by 1 $SF_6$ - 15 $CO_2$ - 84 halogenated alkane
10 $SF_6$ - 1 $CO_2$ - 89 halogenated alkane.

Many mixtures may require somewhat more $SF_6$ and/or $CO_2$. As before, such a determination is within the ability of one skilled in the art. The Examples section below sets forth the details for determining such ranges and lists preferred examples.

Within the broad range of compositions useful for carbon formation suppression, many ternary mixtures evidence an unexpected enhancement of dielectric strength. Preferred examples of these systems include $SF_6$-$CO_2$-$CCl_2F_2$, $SF_6$-$CO_2$-$CHClF_2$, $SF_6$-$CO_2$-$CClF_2CClF_2$, $SF_6$-$CO_2$-$CClF_2CF_3$, $SF_6$-$CO_2$-$CBrF_3$, $SF_6$-$CHF_3$-$CHClF_2$ and $CO_2$-$CF_3CF_3$-c-$C_4F_8$. Mixture possessing this property are also listed in the Examples section.

Figure 4:
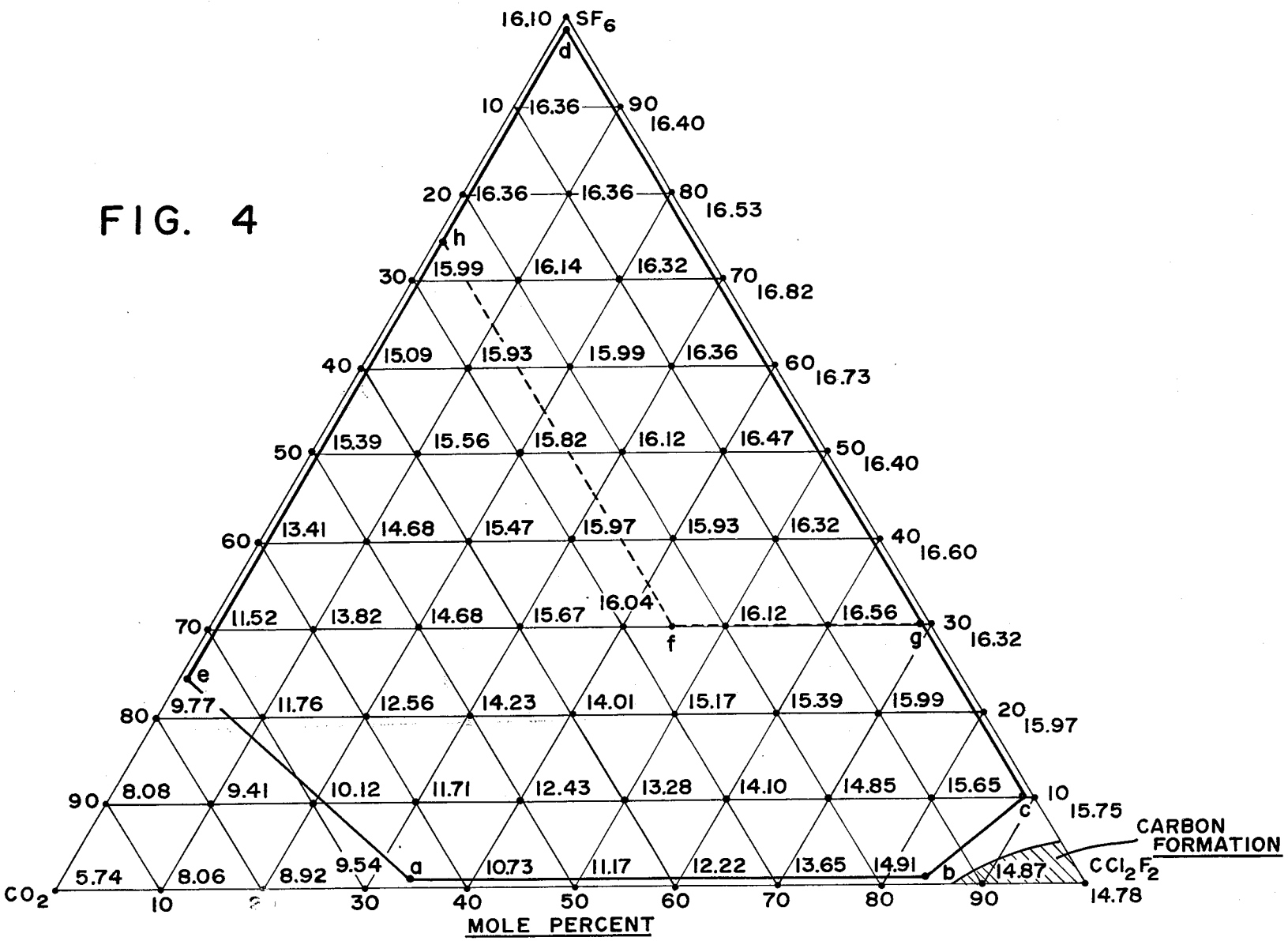
FIG. 4, on coordinates of concentration in mole percent, is a ternary plot of the system $SF_6$-$CO_2$-$CCl_2F_2$, showing useful regions of carbon formation suppression and improved dielectric strength.

An example of both carbon formation suppression and improved dielectric strength in accordance with the invention is shown in FIG. 4, which is a plot of breakdown voltage in kv-rms as a function of composition in mole percent for the ternary system $SF_6$-$CO_2$-$CCl_2F_2$. Carbon formation appears for compositions rich in $CCl_2F_2$, defined by a line having at its extremities the points defined by b. 1 $SF_6$- 15 $CO_2$- 84 $CCl_2F_2$
c. 10 $SF_6$- 1 $CO_2$- 89 $CCl_2F_2$.

This system evidences useful dielectric behavior within an area on the ternary diagram defined by a polygon a-b-c-d-e-a having at its corners the points defined by:

a. 1 $SF_6$ - 65 $CO_2$ - 34 $CCl_2F_2$
b. 1 $SF_6$ - 15 $CO_2$ - 84 $CCl_2F_2$
c. 10 $SF_6$ - 1 $CO_2$ - 89 $CCl_2F_2$ d. 98 $SF_6$ - 1 $CO_2$ - 1 $CCl_2F_2$
e. 24 $SF_6$ - 75 $CO_2$ - 1 $CCl_2F_2$.

There is a synergistic BDV effect within an area on the ternary diagram defined by a polygon f-g-d-h-f having at its corners the points defined by f. 30 $SF_6$ - 25 $CO_2$ - 45 $CCl_2F_2$
g. 30 $SF_6$ - 1 $CO_2$ - 69 $CCl_2F_2$
d. 98 $SF_6$ - 1 $CO_2$ - 1 $CCl_2F_2$
h. 74 $SF_6$ - 25 $CO_2$ - 1 $CCl_2F_2$.

See also Examples 2 and 21, below.

Figure 5:
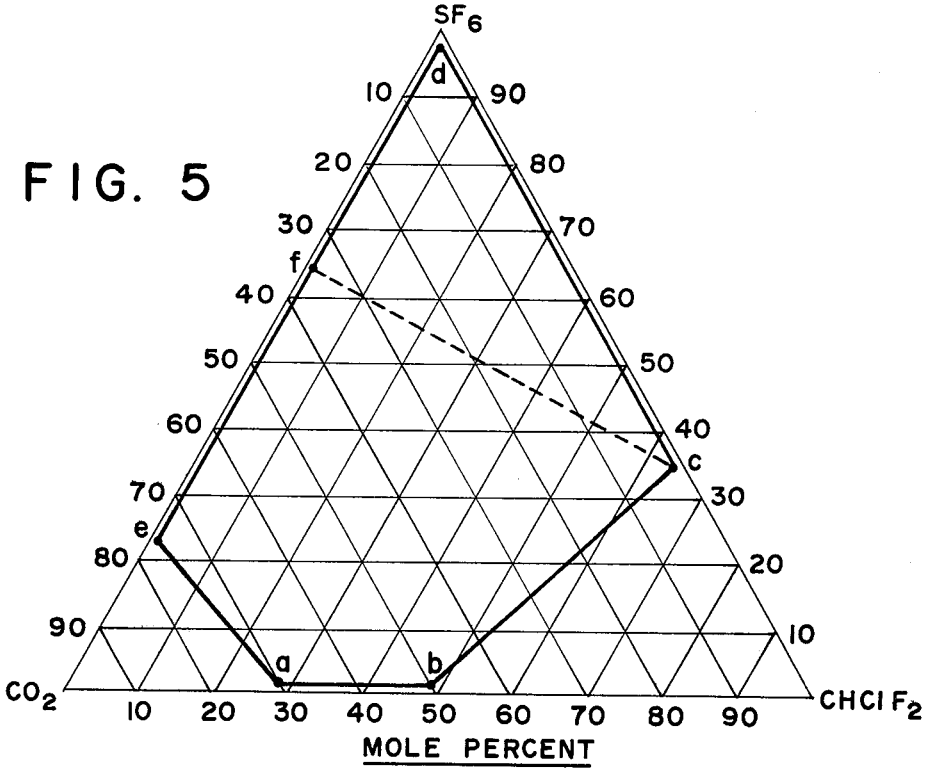
FIG. 5, on coordinates of concentration in mole percent, is a ternary plot of the system $SF_6$-$CO_2$-$CHClF_2$, showing useful regions of carbon formation suppression and improved dielectric strength.
Figure 6:
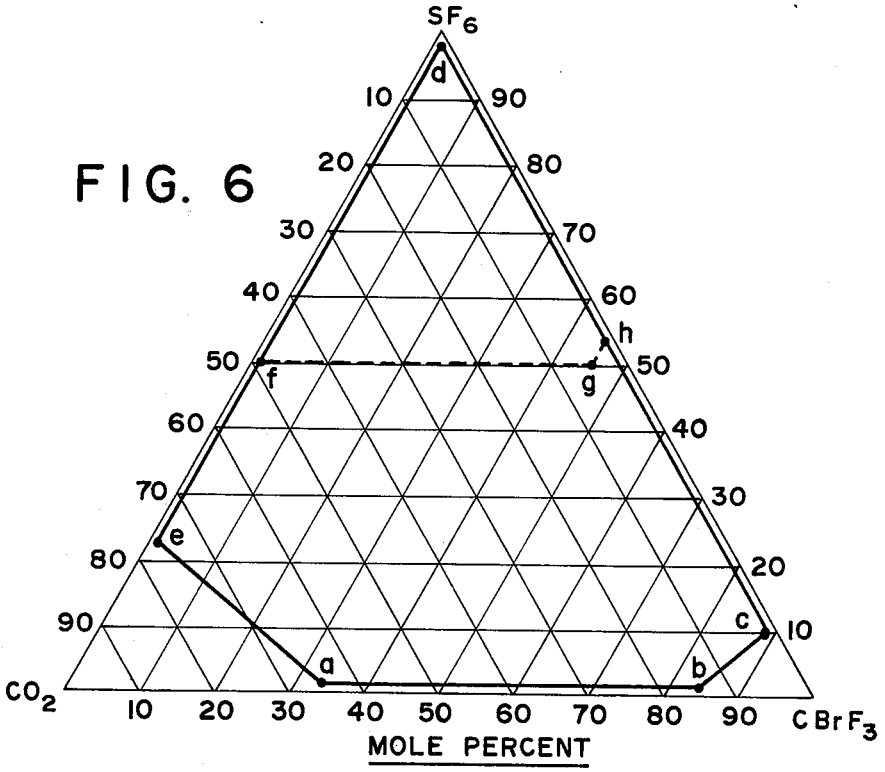
FIG. 6, on coordinates of concentration in mole percent, is a ternary plot of the system $SF_6$-$CO_2$-$CBrF_3$, showing useful regions of carbon formation suppression and improved dielectric strength.
Figure 7:
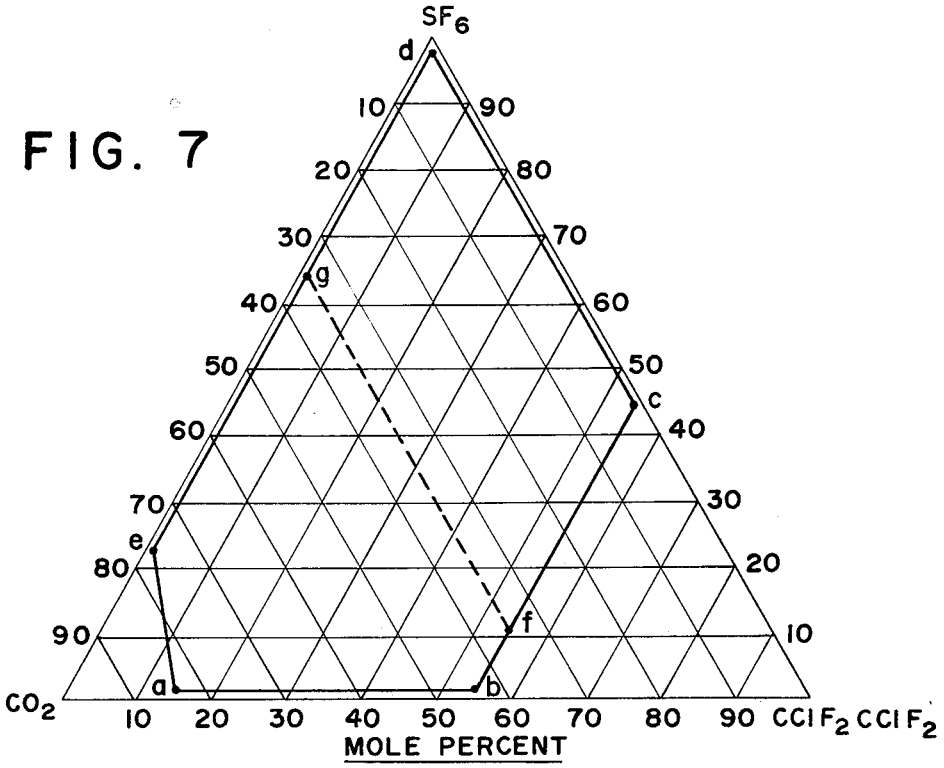
FIG. 7, on coordinates of concentration in mole percent, is a ternary plot of the system $SF_6$-$CO_2$-$CClF_2CClF_2$, showing useful regions of carbon formation suppression and improved dielectric strength.
Figure 8:
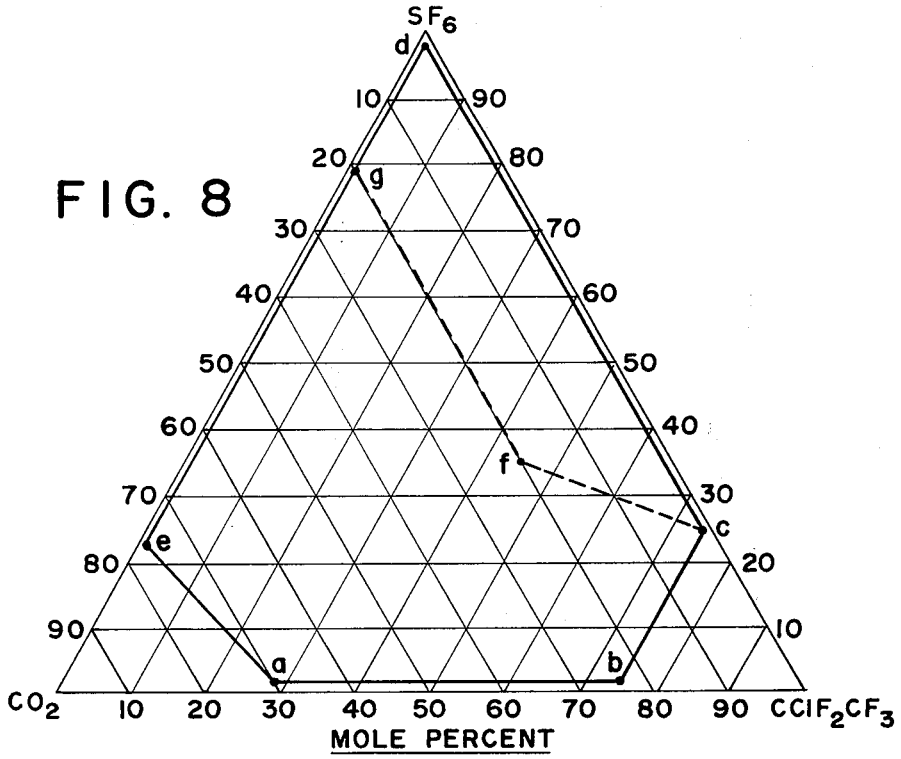
FIG. 8, on coordinates of concentration in mole percent, is a ternary plot of the system $SF_6$-$CO_2$-$CClF_2CF_3$, showing useful regions of carbon formation suppression and improved dielectric strength.
Figure 9:
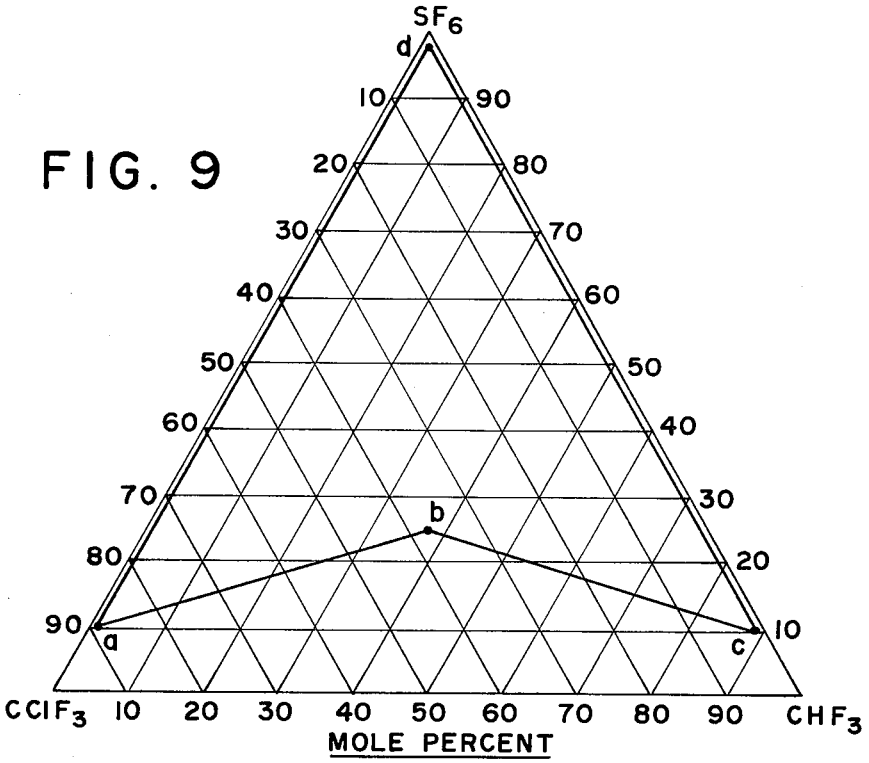
FIG. 9, on coordinates of concentration in mole percent, is a ternary plot of the system $SF_6$-$CClF_3$-$CHF_3$, showing useful regions of carbon formation suppression.

Other preferred examples are depicted in FIGS. 5 through 10. The figures are associated with the following systems, which are explained in further detail in the Examples section below: FIG. 5, $SF_6$-$CO_2$-$CHClF_2$ (Example 22); FIG. 6, $SF_6$-$CO_2$-$CBrF_3$ (Example 23); FIG. 7, $SF_6$-$CO_2$-$CClF_2CClF_2$ (Example 25); FIG. 8, $SF_6$-$CO_2$-$CClF_2CF_3$ (Example 26); FIG. 9, $SF_6$-$CClF_3$-$CHF_3$ (Example 27) and FIG. 10, $CO_2$-$CF_3CF_3$-c-$C_4F_8$ (Example 34).

Quaternary and higher compositions within the above definition may also be formulated in accordance with the invention. One such example is $SF_6$-$CO_2$-$CCl_2F_2$-$CClF_2CF_3$ (Example 36).

The considerations in choosing a particular system include the cost of the components, the temperature performance desired (low or high), the electrical properties desired, and the relative saftey of the total mixture.

EXAMPLES

I. Description of Test Procedure

Breakdown voltage (BDV) was measured by equipment which included a glass breakdown voltage cell as described by ASTM D2477-66T, a 50 kv-rms (kilovolt-root mean square), 60 Hz, 5 kva transformer and suitable accessory circuits. A vacuum manifold with Bourdon Tube type manometer, solenoid valves and controls was also used.

The cell had an 0.75 inch sphere and a 1.5 inch plane electrode. The breakdown cell filling manifold, using solenoid valves, furnished connections to the cell, the manometer, various gas inlets and the vacuum pump. The manometer was a Wallace and Tiernan model 62A-4D-0800, ranging in two rotations of the indicator needle between 0 and 800 Torr absolute. A simple control panel governed the solenoid valves used to admit the various gases of the mixtures in the BDV cell. The BDV measurement conditions were 60 Hz, 0.100 inch gap, 760 Torr total pressure and ambient room temperature. Compositions were prepared in terms of partial pressure, accurate to ± 0.5 Torr, and converted to mole percent.

The electrodes had to be polished prior to taking BDV data. They were polished with E5 emergy grit, soaked in xylene for 30 min, rinsed with petroleum ether and dried at 100° C for 15 min. A few preliminary breakdown voltage shots were necessary prior to taking data to condition the electrodes. Even so, the BDV of pure components, such as $SF_6$, was observed to vary slightly from one experiment to the next.

For measuring carbon formation suppression, there were two levels of testing. In the first, any carbon appearing after 5 BDV shots was monitored as a "go-no go" test. For a more severe exposure test, 50 successive BDV shots were taken in the same manner.

Carbon tetrafluoride, $CF_4$, the most stable fluorocarbon known, and nitrogen, $N_2$, served as inert diluents and blanks. In the test for carbon formation, the measurements started at high $SF_6$ or $CO_2$ concentrations. These were gradually reduced until carbon deposits appeared. Carbon was usually observed to form on the grounded plane electrode.

EXAMPLE 1

Procedure for Measurement of Breakdown Voltage

This Example demonstrates the breakdown voltage measurement by the ASTM D2477-66T method, using a mixture of $SF_6$ and $CCl_2F_2$. The equipment included a vacuum manifold, the glass breakdown voltage cell, 0 to 50 kv test set rated at 5 kva and 40,000 ohms of 250 watt current limiting resistors. The manifold had valved connections to air, to the vacuum pump, to the manometer and to three cylinders which contained components A, B or C.

An air gap of two 12.5 cm diameter brass spheres served for a peak voltage calibration standard. Prior to measurement, the transformer's voltmeters were calibrated with this gap using the BDV methods of ASTM D2477-66T, i.e., averaging 5 successive spark breakdowns at set gap distances. The voltmeters were accurate to 0.5 kv, or within calibration In preparing a test sample, the ideal gas law was used, and pressure percent was assumed equal to mole percent. The desired mole percent of each component was calculated as the number of Torr compared to 760 Torr (1 atmosphere), which yielded the desired mole percent. Prior to make-up of the composition, the test cell was evacuated to less than 1 Torr. During make-up of the composition, the component to be present in the smallest amount was admitted first, until it attained the desired partial pressure. This was followed by the component with the next highest percentage and finally by the component present in the largest mole fraction. Table II below presents the pressures used for some $SF_6$-$CCl_2F_2$ mixtures, together with the breakdown voltage of each composition and its standard deviation (SD).

TABLE II

BREAKDOWN VOLTAGE OF $SF_6$-$CCl_2F_2$ MIXTURES

| $SF_6$ | | $CCl_2F_2$ | | BDV, | ± SD, |
|---|---|---|---|---|---|
| Mole % | P,Torr | Mole % | P,Torr | Kv-rms* | Kv-rms* |
| 100 | 760 | 0 | 0 | 17.43 | 0.33 |
| 80 | 608 | 20 | 152 | 17.74 | 0.51 |
| 60 | 456 | 40 | 304 | 18.53 | 0.29 |
| 40 | 304 | 60 | 456 | 18.46 | 0.51 |
| 20 | 152 | 80 | 608 | 17.90 | 0.43 |
| 0 | 0 | 100 | 760 | 17.28 | 0.32 |

*rms = root mean square value, i.e. BDV rms = 0.707 BDV peak.

Synergism is indicated in the magnitude of about 1 kv-rms greater than the breakdown voltage of $SF_6$ over the range of about 40 to 60 mole percent of $SF_6$; see also FIG. 2 and Example 4, below.

EXAMPLE 2

Process for Measurement of Carbon Formation Suppression

This Example describes the method of measuring carbon formation suppression, using $SF_6$, $CO_2$ and $CCl_2F_2$. The equipment of Example 1 was used for the tests. The compositions were again made up using pressure percent (mole percent) at one atmosphere total pressure. To evaluate carbon formation, a given sample of definite composition was repeatedly sparked, as in Example 1, and BDV observed. There were two levels of exposure, 10 sparks and 50 sparks, all applied successively to the same gas sample. If carbon appeared, the BDV cell was disassembled and the electrodes cleaned and conditioned again.

Table III presents the pressures and compositions of the samples, the observed breakdown voltages and the number of shots which did, or did not, produce carbon. With these mixtures, a 5 percent change in composition caused a large increase in carbon formation suppression: at 90 $CCl_2F_2$ - 10 $CO_2$, carbon formed after 20 sparks, whereas at 85 $CCl_2F_2$ - 15 $CO_2$, no carbon appeared after 50 sparks. Similarly, pure $CF_2Cl_2$ formed carbon after 10 sparks, while at 95 $CCl_2F_2$ - 5 $SF_6$, no carbon appeared after 50 sparks. A detailed study of this system is shown in FIG. 4 and is discussed below in further detail in EXample 21. In FIG. 4, the breakdown voltages of compositions in the system $SF_6$-$CO_2$-$CCl_2F_2$ are depicted on a ternary plot as a function of mole percent.

TABLE III

CARBON FORMATION RESULTS FOR $SF_6$-$CO_2$-$CCl_2F_2$ MIXTURES

| COMPOSITIONS | | | | | | ELECTRICAL | | CRABON | |
|---|---|---|---|---|---|---|---|---|---|
| $SF_6$ | | $CCl_2F_2$ | | $CO_2$ | | BDV, | SD, | Number of Sparks | |
| mole % | P, Torr | mole % | P, Torr | mole % | P, Torr | kv | kv | C Forms | No C |
| 100 | 760 | 0 | — | 0 | — | 17.43 | 0.3 | — | — |
| 0 | — | 100 | 760 | 0 | — | 17.43 | 0.3 | 10 | — |
| 5 | 38 | 95 | 722 | 0 | — | 16.89 | 0.7 | — | 50 |
| 0 | — | 90 | 684 | 10 | 76 | 15.04 | 1.0 | 20 | — |
| 0 | — | 85 | 646 | 15 | 114 | 13.28 | 0.7 | — | 50 |
| 50 | 380 | 46 | 349.6 | 4 | 30.4 | 18.71 | 0.4 | — | 50 |
| 75 | 570 | 20 | 152 | 5 | 38.0 | 20.20 | 1.0 | — | 50 |

II. Binary Mixtures

A. $SF_6$ Binary Mixtures

The breakdown voltage data for binary mixtures which included $SF_6$ is listed in Table IV. From the data given, both the minimum amount of $SF_6$ useful in suppressing carbon formation and the useful range for gaseous dielectric behavior may be determined. Many binary mixtures evidenced breakdown voltage values within about 90% of that of the higher end member over a range of compositions; such mixtures are preferred. Certain binary mixtures evidenced unexpectedly high breakdown voltage values compared with the values of either end member. Since the normal expected behavior is a linear dependence with composition, such unusual behavior is termed a synergistic effect, and such mixtures are also preferred. Following Table IV is a discussion of some of the binary mixtures including $SF_6$ and their utility.

EXAMPLE 3

System $SF_2$-$CCl_3F$

A BDV of 23.7 kv was observed for $CCl_3F$, compared with a value of 18.1 kv for $SF_6$. The system evidenced useful dielectric behavior over the range of about 30 to 99 mole percent of $SF_6$. The BDV was at least 90% that of $CCl_3F$ over the range of about 30 to 70 mole percent of $SF_6$. At least about 30 mole percent of $SF_6$ was required to suppress carbon formation in $CCl_3F$.

The combination of $SF_6$ and $CCl_3F$ is an inexpensive dielectric mixture. The preferred operating temperature range is greater than ambient but less than 150° C.

EXAMPLE 4

System $SF_6$-$CCl_2F_2$ (FIG. 2, curve 20)

This system evidenced useful dielectric behavior over the range of about 10 to 99 mole percent of $SF_6$. There was a synergistic BDV effect over the range of about 40 to 80 mole percent of $SF_6$. At least about 10 mole percent $SF_6$ was required to suppress carbon formation in $CCl_2F_2$.

The combination of $SF_6$ and $CCl_2F_2$ is an inexpensive dielectric mixture for use in units such as underground or underwater high voltage coaxial lines, capacitors and in gas filled transformers.

EXAMPLE 5

System $SF_6$-$CClF_3$ (FIG. 2, curve 23)

This system evidenced useful dielectric behavior over the range of about 15 to 99 mole percent of $SF_6$. The BDV was at least 90% that of $SF_6$ over the range of about 60 to 99 mole percent of $SF_6$. There was a synergistic BDV effect over a narrow range of about 75 to 85 mole percent of $SF_6$. At least about 15 mole per-

TABLE IV $SF_6$ BINARY MIXTURES

Breakdown Voltage, kv-rms, as a Function of $SF_6$ Addition

| Composition | 0 | 10 | 20 | 25 | 30 | 40 | 50 | 60 | 70 | 75 | 80 | 90 | 100 | Min. Diluent, Mole % |
|---|---|---|---|---|---|---|---|---|---|---|---|---|---|---|
| $CCl_3F$ | 23.66* | 23.77* | 23.45* | 23.32* | | 23.23 | 23.50 | 21.98 | 21.00 | 21.00 | 20.80 | 18.17 | 18.10 | 30 |
| $CCl_2F_2$ | 14.78* | 15.75 | 15.97 | | 16.32 | 16.60 | 16.40 | 16.73 | 16.82 | | 16.53 | 16.40 | 16.10 | 10 |
| $CClF_3$ | 7.14* | 7.66 | 11.95 | | 13.86 | 14.63 | 15.04 | 14.70 | 15.32 | | 15.24 | 15.65 | 15.79 | 10 |
| $CBrF_3$ | 13.50* | 13.78 | 15.21 | | 15.45 | 14.70 | 15.34 | 18.26 | 18.96 | | 19.43 | 16.80 | 16.79 | 10 |
| $CHClF_2$ | 4.79* | 8.88* | 10.70* | | 13.11* | 15.41 | 16.58 | 16.36 | 16.51 | | 16.58 | 16.36 | 16.32 | 35 |
| $CHF_3$ | 5.74* | 6.65 | 7.51 | | 10.70 | 12.56 | 13.56 | 14.40 | 14.91 | | 14.76 | 15.39 | 16.32 | 10 |
| $CCl_2FCClF_2$ | | | | | | | 20.53 | 19.94 | 18.76 | | 17.66 | 16.99 | 16.32 | 50 |
| $CClF_2CClF_2$ | 21.84* | 21.55* | 21.41* | | 21.23* | 20.94 | 20.62 | 20.40 | 20.15 | | 19.86 | 19.07 | 16.61 | 45 |
| $CClF_2CF_3$ | 16.72* | 16.83* | 17.34* | | 17.92 | 20.51 | 20.06 | 18.08 | 16.99 | | 17.25 | 17.41 | 16.90 | 25 |
| $CF_3CF_3$ | 15.0* | | | 15.8 | | | 16.3 | | | 17.0 | | | 16.9 | 20 |
| c-$C_4F_8$ | 19.90* | 18.53* | 18.60* | | 19.54* | 19.92 | 19.97 | 19.50 | 18.92 | | 18.78 | 17.92 | 17.70 | 35 |
| $CF_4$ | 10.8 | | | 11.3 | | | 14.7 | | | 17.5 | | | 19.1 | — |
| $N_2$ | 8.5 | | | 13.7 | | | 18.9 | | | 20.4 | | | 21.9 | — |
| $CO_2$ | 6.20 | 8.50 | 10.19 | | 11.39 | 12.46 | 14.20 | 16.38 | 16.81 | | 16.83 | 16.87 | 16.56 | — |

*Carbon formation observed.

cent of $SF_6$ was required to suppress carbon formation in $CClF_3$.

This system is useful in raising the vapor pressure of $SF_6$ without substantially decreasing the BDV. Hence, it is suitable for low temperature use in transformers and capacitors.

EXAMPLE 6

System $SF_6$-$CBrF_3$

This system evidenced useful dielectric behavior over the range of about 10 to 99 mole percent of $SF_6$. The BDV was at least 90% that of $SF_6$ over the range of about 20 to 99 mole percent of $SF_6$. There was a synergistic BDV effect over the range of about 60 to 85 mole percent of $SF_6$. At least about 10 mole percent of $SF_6$ was required to suppress carbon formation in $CBrF_3$.

EXAMPLE 7

System $SF_6$-$CHClF_2$ (FIG. 2, curve 21)

An $SF_6$-$CHClF_2$ azeotrope existed at 90 mole percent of $SF_6$. This system evidenced useful dielectric behavior over the range of about 35 to 99 mole percent $SF_6$. A synergistic effect was observed over a narrow range of about 40 to 50 mole percent of $SF_6$. At least about 35 mole percent of $SF_6$ was required to suppress carbon formation in $CHClF_2$.

The combination of $SF_6$ and $CHClF_2$ is an inexpensive dielectric mixture with only a slight compromise in $SF_6$ BDV and vapor pressure.

EXAMPLE 8

System $SF_6$-$CHF_3$

This system evidenced useful dielectric behavior over the range of about 15 to 99 mole percent of $SF_6$. The BDV was at least 90% that of $SF_6$ over the range of about 65 to 99 mole percent of $SF_6$. At least about 15 mole percent of $SF_6$ was required to suppress carbon formation in $CHF_3$.

The use of $CHF_3$ can increase the vapor pressure of $SF_6$ without substantial $SF_6$ BDV decrease, either alone or together with an azeotropic mixture of $CClF_3$. These gaseous dielectric mixtures are useful in low temperature applications, such as gas filled transformers which are exposed to winter conditions.

EXAMPLE 9

System $SF_6$-$CClF_2CClF_2$ (FIG. 2, curve 22)

A BDV of 21.8 kv was observed for $CClF_2CClF_2$, compared with a value of 16.6 kv for $SF_6$. The system evidenced useful dielectric behavior over the range of about 45 to 99 mole percent of $SF_6$. The BDV was at least 90% that of $CClF_2CClF_2$ over the range of about 45 to 85 mole percent of $SF_6$. At least about 45 mole percent of $SF_6$ was required to suppress carbon formation in $CClF_2CClF_2$. This system evidenced a substantial BDV improvement over $SF_6$ alone.

The relatively high boiling point of $CClF_2CClF_2$ (3.6° C) limits low temperature uses of this system, but at ambient room temperature or above, it is a satisfactory dielectric mixture at only moderate cost.

EXAMPLE 10

System $SF_6$-$CClF_2CF_3$ (FIGS. 1, curve 10, and 2, curve 24)

This system evidenced useful dielectric behavior over the range of about 25 to 99 mole percent of $SF_6$. There was a synergistic effect over the range of about 25 to 90 mole percent of $SF_6$, and a substantial synergistic effect (greater than about 1 kv) over the range of about 30 to 60 mole percent of $SF_6$. At least about 25 mole percent of $SF_6$ was required to suppress carbon formation in $CClF_2CF_3$.

The combination of $SF_6$ and $CClF_2CF_3$ is an inexpensive gaseous dielectric mixture having the same or higher dielectric strength than $SF_6$ alone.

EXAMPLE 11

System $SF_6$-$CF_3CF_3$

This system evidenced useful dielectric behavior over the range of about 20 to 99 mole percent of $SF_6$. At least about 20 mole percent $SF_6$ was required to suppress carbon formation in $CF_3CF_3$.

Due to the low boiling point of $CF_3CF_3$ (−78° C) and its good thermal stability, mixtures of $CF_3CF_3$ with $SF_6$ are desirable for low temperature applications. Also, since $CF_3CF_3$ is a very thermally stable gas, the addition of sufficient $SF_6$ to suppress carbon formation (about 20 mole percent) should lead to a more desirable high temperature gaseous dielectric mixture for use in transformers.

EXAMPLE 12

System $SF_6$-c-$C_4F_8$

A BDV of 19.9 kv was observed for c-$C_4F_8$, compared with a value of 17.7 kv for $SF_6$. The system evidenced useful dielectric behavior over the range of about 35 to 99 mole percent of $SF_6$. At least about 35 mole percent of $SF_6$ was required for carbon formation suppression.

The $SF_6$-c-$C_4F_8$ system has a higher BDV than $SF_6$ alone. It is not suitable for use below 0° C due to the high boiling point of c-$C_4F_8$ (−60° C). On the other hand, c-$C_4F_8$ can be a component in high temperature gaseous dielectric mixtures; see also its use with $CO_2$ in Example 20, below.

B. $CO_2$ Binary Mixtures

The breakdown voltage data for binary mixtures which included $CO_2$ are listed in Table V. From the data given, both the minimum amount of $CO_2$ useful in suppressing carbon formation and the useful range for gaseous dielectric behavior may be determined. As before, mixtures evidencing at least 90% of the breakdown voltage of the higher of the two components are preferred, as are synergistic compositions. Following Table V is a discussion of some of the binary mixtures including $CO_2$ and their utility.

In general, while $CO_2$ binary mixtures tended to evidence less BDV synergism than did the $SF_6$ binary mixtures, they evidenced good carbon formation suppression properties. Except in special applications, such as low voltage use, mixtures evidencing breakdown voltages of less than about 10 kv-rms are not considered to be as useful as those greater than about 10 kv-rms.

TABLE V $CO_2$ BINARY MIXTURES
Breakdown Voltage, kv-rms, as a Function of $CO_2$ Addition

| Composition | 0 | 10 | 20 | 30 | 40 | 50 | 60 | 70 | 80 | 90 | 100 | Min. Diluent. Mole % |
|---|---|---|---|---|---|---|---|---|---|---|---|---|
| $CCl_2F_2$ | 14.78* | 14.89* | 14.91 | 13.65 | 12.22 | 11.17 | 10.73 | 9.54 | 8.92 | 8.06 | 5.74 | 15 |
| $CBrF_3$ | 13.50* | 11.85* | 11.19 | 11.00 | 10.79 | 10.38 | 10.59 | 9.52 | 7.43 | 6.72 | 5.92 | 15 |
| $CHClF_2$ | 5.50* | 6.00* | 7.06* | 8.02* | 10.85* | 11.02 | 10.21 | 9.96 | 8.60 | 7.04 | 6.20 | 45 |
| $CHF_3$ | 5.90* | 6.60* | 6.72 | 6.10 | 5.68 | 5.70 | 5.76 | 5.80 | 5.78 | 5.76 | 5.68 | 15 |
| $CCl_2FCClF_2$ | | | | | | 13.58* | 12.05* | 11.10 | 9.72 | 8.22 | 6.16 | 65 |
| $CClF_2CClF_2$ | 21.84* | 20.87* | 19.83* | 18.71* | 17.50* | 15.54 | 14.40 | 13.33 | 11.08 | 9.04 | 6.22 | 45 |
| $CClF_2CF_3$ | 16.72* | 16.10* | 16.03* | 15.39 | 14.28 | 12.78 | 11.17 | 10.00 | 9.20 | 8.08 | 6.07 | 25 |
| $CF_3CF_3$ | 16.81* | 15.90* | 14.16* | 12.07* | 10.85 | 10.04 | 8.91 | 8.44 | 7.68 | 6.82 | 5.70 | 35 |
| $c\text{-}C_4F_8$ | 16.58* | 16.83* | 17.74* | 16.63* | 16.27* | 18.82* | 17.09 | 13.11 | 9.37 | 9.00 | 5.70 | 55 |

*Carbon formation observed

EXAMPLE 13

System $CO_2$-$CCl_2F_2$ (FIG. 3, curve 31)

This system evidenced useful dielectric behavior over the range of about 15 to 65 mole percent of $CO_2$. The BDV was at least 90% that of $CCl_2F_2$ over the range of about 15 to 35 mole percent of $CO_2$. At least about 15 mole percent of $CO_2$ was required to suppress carbon formation in $CCl_2F_2$.

At about 20 mole percent of $CO_2$, this system has a BDV of 14.9 kv, compared with a BDV of 16.6 kv for pure $SF_6$. This system is an inexpensive gaseous dielectric mixture suitable for operation in the range of about −20° to 150° C.

EXAMPLE 14

System $CO_2$-$CBrF_3$

This system evidenced useful dielectric behavior over the range of about 15 to 65 mole percent of $CO_2$. At least about 15 mole percent of $CO_2$ was required to suppress carbon formation in $CBrF_3$.

This binary system is useful in low temperature applications.

EXAMPLE 15

System $CO_2$-$CHClF_2$ (FIG. 3, curve 30)

This system evidenced useful dielectric behavior over the range of about 45 to 70 mole percent of $CO_2$. There was a synergistic effect over this entire range. At least about 45 mole percent of $CO_2$ was required to suppress carbon formation in $CHClF_2$.

This system is an inexpensive dielectric mixture for low voltage uses when $SF_6$ is not economically practical.

EXAMPLE 16

System $CO_2$-$CHF_3$

This system evidenced useful dielectric behavior over the range of about 15 to 99 mole percent of $CO_2$. There was a synergistic effect over a narrow range of about 15 to 25 mole percent of $CO_2$. At least about 15 mole percent of $CO_2$ was required to suppress carbon formation in $CHF_3$.

EXAMPLE 17

System $CO_2$-$CClF_2CClF_2$

This system evidenced useful dielectric behavior over the range of about 45 to 85 mole percent of $CO_2$. At least about 45 mole percent of $CO_2$ was required to suppress carbon formation in $CClF_2CClF_2$.

EXAMPLE 18

System $CO_2$-$CClF_2CF_3$ (FIG. 1, curve 11)

This system evidenced useful dielectric behavior over the range of about 25 to 70 mole perecent of $CO_2$. The BDV was at least 90% that of $CClF_2CF_3$ over the range of about 25 to 35 mole percent of $CO_2$. At least about 25 mole percent of $CO_2$ was required to suppress carbon formation in $CClF_2CF_3$.

This system is suitable for dry type transformers up to about 250° C and is relatively inexpensive compared with $SF_6$.

EXAMPLE 19

System $CO_2$-$CF_3CF_3$

This system evidenced useful dielectric behavior over the range of about 35 to 50 mole percent of $CO_2$. At least about 35 mole percent of $CO_2$ was required to suppress carbon formation in $CF_3CF_3$.

EXAMPLE 20

System $CO_2$-$c\text{-}C_4F_8$

This system evidenced useful dielectric behavior over the range of about 55 to 75 mole percent of $CO_2$. At least about 55 mole percent $CO_2$ was required to suppress carbon formation in $c\text{-}C_4F_8$.

This system can be used in formulating multi-component mixtures which do not contain $SF_6$ and which are suitable for operating temperatures up to about 300° C.

III. Multicomponent Mixtures

Data for these mixtures are most conveniently represented on ternary diagrams expressed in mole percent.

EXAMPLE 21

System $SF_6$-$CO_2$-$CCl_2F_2$ (FIG. 4)

This system evidenced useful dielectric behavior within an area on a ternary diagram defined by a polygon a-b-c-d-e-a having at its corners the points defined by a. 1 $SF_6$ - 65 $CO_2$ - 34 $CCl_2F_2$
b. 1 $SF_6$ - 15 $CO_2$ - 84 $CCl_2F_2$
c. 10 $SF_6$ - 1 $CO_2$ - 89 $CCl_2F_2$
d. 98 $SF_6$ - 1 $CO_2$ - 1 $CCl_2F_2$
e. 24 $SF_6$ - 75 $CO_2$ - 1 $CCl_2F_2$.

There was a synergistic BDV effect within an area on the ternary diagram defined by a polygon f-g-d-h-f having at its corners the points defined by f. 30 $SF_6$ - 25 $CO_2$ - 45 $CCl_2F_2$
g. 30 $SF_6$ - 1 $CO_2$ - 69 $CCl_2F_2$
d. 98 $SF_6$ - 1 $CO_2$ - 1 $CCl_2F_2$ h. 74 $SF_6$ - 25 $CO_2$ - 1 $CCl_2F_2$.

Carbon formation was suppressed for compositions lying in regions rich in $SF_6$ and $CO_2$ defined by a line b-c having at its extremities the points defined by b. 1 $SF_6$ - 15 $CO_2$ - 84 $CCl_2F_2$ c. 10 $SF_6$ - 1 $CO_2$ - 89 $CCl_2F_2$.

This system is an inexpensive gaseous dielectric mixture suitable for coaxial lines exposed to temperatures down to −30° C.

EXAMPLE 22

System $SF_6CO_2$-$CHClF_2$ (FIG. 5)

This system evidenced useful dielectric behavior within an area on a ternary diagram defined by a polygon a-b-c-d-e-a having at its corners the points defined by a. 1 $SF_6$ - 70 $CO_2$ - 29 $CHClF_2$
b. 1 $SF_6$ - 50 $CO_2$ - 49 $CHClF_2$
c. 35 $SF_6$ - 1 $CO_2$ - 64 $CHClF_2$
d. 98 $SF_6$ - 1 $CO_2$ - 1 $CHClF_2$
e. 24 $SF_6$ - 75 $CO_2$ - 1 $CHClF_2$.

There was the synergistic BDV effect within an area on the ternary diagram defined by a polygon c-d-f-c having at its corners the points defined by c. 35 $SF_6$ - 1 $CO_2$ - 64 $CHClF_2$
d. 98 $SF_6$ - 1 $CO_2$ - 1 $CHClF_2$
f. 64 $SF_6$ - 35 $CO_2$ - 1 $CHClF_2$.

Carbon formation was suppressed for compositions lying in regions rich in $SF_6$ and $CO_2$ defined by a line b-c having at its extremities the points defined by b. 1 $SF_6$ - 50 $CO_2$ - 49 $CHClF_2$
c. 35 $SF_6$ - 1 $CO_2$ - 64 $CHClF_2$.

EXAMPLE 23

System $SF_6$-$CO_2$-$CBrF_3$ (FIG. 6)

This system evidenced useful dielectric behavior within an area on a ternary diagram defined by a polygon a-b-c-d-e-a having at its corners the points defined by a. 1 $SF_6$ - 65 $CO_2$ - 34 $CBrF_3$
b. 1 $SF_6$ - 15 $CO_2$ - 84 $CBrF_3$
c. 10 $SF_6$ - 1 $CO_2$ - 89 $CBrF_3$
d. 98 $SF_6$ - 1 $CO_2$ - 1 $CBrF_3$
e. 24 $SF_6$ - 75 $CO_2$ - 1 $CBrF_3$.

There was a synergistic BDV effect within an area on the ternary diagram defined by a polygon f-g-h-d-f having at its corners the points defined by f. 50 $SF_6$ - 49 $CO_2$ - 1 $CBrF_3$
g. 50 $SF_6$ - 5 $CO_2$ - 45 $CBrF_3$
h. 54 $SF_6$ - 1 $CO_2$ - 45 $CBrF_3$
d. 98 $SF_6$ - 1 $CO_2$ - 1 $CBrF_3$.

Carbon formation was suppressed for compositions lying in regions rich in $SF_6$ and $CO_2$ defined by a line b-c having at its extremities the points defined by b. 1 $SF_6$ - 14 $CO_2$ - 85 $CBrF_3$
c. 14 $SF_6$ - 1 $CO_2$ - 85 $CBrF_3$.

EXAMPLE 24

System $SF_6$-$CO_2$-$CCl_2FCClF_2$

This system evidenced useful dielectric behavior within an area on a ternary diagram defined by a polygon having at its corners the points defined by 1 $SF_6$ - 74 $CO_2$ - 25 $CCl_2FCClF_2$
25 $SF_6$ - 50 $CO_2$ - 25 $CCl_2FCClF_2$
38 $SF_6$ - 1 $CO_2$ - 61 $CCl_2FCClF_2$
98 $SF_6$ - 1 $CO_2$ - 1 $CCl_2FCClF_2$
25 $SF_6$ - 74 $CO_2$ - 1 $CCl_2FCClF_2$.

Carbon formation was suppressed for compositions lying in regions rich in $SF_6$ and $CO_2$ defined by two lines having at their extremities the points defined by 1. 1 $SF_6$ - 74 $CO_2$ - 25 $CCl_2FCClF_2$
25 $SF_6$ - 50 $CO_2$ - 25 $CCl_2FCClF_2$
2. 25 $SF_6$ - 50 $CO_2$ - 25 $CCl_2FCClF_2$
38 $SF_6$ - 1 $CO_2$ - 61 $CCl_2FCClF_2$.

EXAMPLE 25

System $SF_6$-$CO_2$-$CClF_2CClF_2$ (FIG. 7)

This system evidenced useful dielectric behavior within an area on a ternary diagram defined by a polygon a-b-c-d-e-a having at its corners the points defined by a. 1 $SF_6$ - 85 $CO_2$ - 14 $CClF_2CClF_2$
b. 1 $SF_6$ - 45 $CO_2$ - 54 $CClF_2CClF_2$
c. 45 $SF_6$ - 1 $CO_2$ - 54 $CClF_2CClF_2$
d. 98 $SF_6$ - 1 $CO_2$ - 1 $CClF_2CClF_2$
e. 24 $SF_6$ - 75 $CO_2$ - 1 $CClF_2CClF_2$.

There was a synergistic BDV effect within an area on the ternary diagram defined by a polygon f-c-d-g-f having at its corners the points defined by f. 11 $SF_6$ - 35 $CO_2$ - 54 $CClF_2CClF_2$
c. 45 $SF_6$ - 1 $CO_2$ - 54 $CClF_2CClF_2$
d. 98 $SF_6$ - 1 $CO_2$ - 1 $CClF_2CClF_2$
g. 64 $SF_6$ - 35 $CO_2$ - 1 $CClF_2CClF_2$.

Carbon formation was suppressed for compositions lying in regions rich in $SF_6$ and $CO_2$ defined by a line b-c having at its extremities the points defined by b. 1 $SF_6$ - 45 $CO_2$ - 54 $CClF_2CClF_2$
c. 45 $SF_6$ - 1 $CO_2$ - 54 $CClF_2CClF_2$.

EXAMPLE 26

System $SF_6$-$CO_2$-$CClF_2CF_3$ (FIG. 8)

This system evidenced useful dielectric behavior within an area on a ternary diagram defined by a polygon a-b-c-d-e-a having at its corners the points defined by a. 1 $SF_6$ - 70 $CO_2$ - 29 $CClF_2CF_3$
b. 1 $SF_6$ - 25 $CO_2$ - 74 $CClF_2CF_3$
c. 25 $SF_6$ - 1 $CO_2$ - 74 $CClF_2CF_3$
d. 98 $SF_6$ - 1 $CO_2$ - 1 $CClF_2CF_3$
e. 24 $SF_6$ - 75 $CO_2$ - 1 $CClF_2CF_3$.

There was a synergistic effect within an area on the ternary diagram defined by a polygon f-c-d-g-f having at its corners the points defined by f. 35 $SF_6$ - 20 $CO_2$ - 45 $CClF_2CF_3$
c. 25 $SF_6$ - 1 $CO_2$ - 74 $CClF_2CF_3$
d. 98 $SF_6$ - 1 $CO_2$ - 1 $CClF_2CF_3$
g. 79 $SF_6$ - 20 $CO_2$ - 1 $CClF_2CF_3$.

Carbon formation was suppressed for compositions lying in regions rich in $SF_6$ and $CO_2$ defined by a line b-c having at its extremities the points defined by b. 1 $SF_6$ - 25 $CO_2$ - 74 $CClF_2CF_3$
c. 25 $SF_6$ - 1 $CO_2$ - 74 $CClF_2CF_3$.

EXAMPLE 27

System $SF_6$-$CClF_3$-$CHF_3$ (FIG. 9)

The system evidenced useful dielectric behavior within an area on a ternary diagram defined by a polygon a-b-c-d-a having at its corners the points defined by a. 10 $SF_6$ - 89 $CClF_3$ - 1 $CHF_3$
b. 25 $SF_6$ - 37.5 $CClF_3$ - 37.5 $CHF_3$
c. 10 $SF_6$ - 1 $CClF_3$ - 89 $CHF_3$
d. 98 $SF_6$ - 1 $CClF_3$ - 1 $CHF_3$.

Carbon formation was suppressed for compositions lying in regions rich in $SF_6$ defined by two lines, a-b and b-c, having at their extremities the points defined by 1. a. 10 $SF_6$ - 89 $CClF_3$ -1 $CHF_3$
b. 25 $SF_6$ - 37.5 $CClF_3$ - 37.5 $CHF_3$
2. b. 25 $SF_6$ - 37.5 $CClF_3$ - 37.5 $CHF_3$
c. 10 $SF_6$ - 1 $CClF_3$ - 89 $CHF_3$.

This system is useful in gas filled transformers operating under winter conditions and in circuit breaker controls.

EXAMPLE 28

System $SF_6$-$CHF_3$-$CHClF_2$

This system evidenced useful dielectric behavior within an area on a ternary diagram defined by a polygon having at its corners the points defined by 20 $SF_6$ - 79 $CHF_3$ - 1 $CHClF_2$
44 $SF_6$ - 1 $CHF_3$ - 60 $CHClF_2$
98 $SF_6$ - 1 $CHF_3$ - 1 $CHClF_2$.

There was a synergistic BDV effect within an area on the ternary diagram defined by a polygon having at its corners the points defined by 45 $SF_6$ - 5 $CHF_3$ - 50 $CHClF_2$
49 $SF_6$ - 1 $CHF_3$ - 50 $CHClF_2$
98 $SF_6$ - 1 $CHF_3$ - 1 $CHClF_2$
94 $SF_6$ - 5 $CHF_3$ - 1 $CHClF_2$.

Carbon formation was suppressed for compositions having in regions rich in $SF_6$ defined by a line having at its extremities the points defined by 20 $SF_6$ - 79 $CHF_3$ - 1 $CHClF_2$
44 $SF_6$ - 1 $CHF_3$ - 60 $CHClF_2$.

EXAMPLE 29.

System $SF_6$-$CCl_2F_2$-$CClF_2CClF_2$

This system evidenced useful dielectric behavior within an area on a ternary diagram defined by a polygon having at its corners the points defined by 10 $SF_6$ - 89 $CCl_2F_2$ - 1 $CClF_2CClF_2$
47 $SF_6$ - 1 $CCl_2F_2$ - 52 $CClF_2CClF_2$
98 $SF_6$ - 1 $CCl_2F_2$ - 1 $CClF_2CClF_2$.

Carbon formation was suppressed for compositions lying in regions rich in $SF_6$ defined by a line having at its extremities the points defined by 10 $SF_6$ - 89 $CCl_2F_2$ - 1 $CClF_2CClF_2$
47 $SF_6$ - 1 $CCl_2F_2$ - 52 $CClF_2CClF_2$.

EXAMPLE 30.

System $SF_6$-$CCl_2F_2$-$CClF_2CF_3$

This system evidenced useful dielectric behavior within an area on a ternary diagram defined by a polygon having at its corners the points defined by 11 $SF_6$ - 88 $CCl_2F_2$ - 1 $CClF_2CF_3$
26 $SF_6$ - 1 $CCl_2F_2$ - 73 $CClF_2CF_3$
98 $SF_6$ - 1 $CCl_2F_2$ - 1 $CClF_2CF_3$.

There was a synergistic BDV effect within an area on the ternary diagram defined by a polygon having at its corners the points defined by 30 $SF_6$ - 55 $CCl_2F_2$ - 15 $CClF_2CF_3$
30 $SF_6$ - 1 $CCl_2F_2$ - 69 $CClF_2CF_3$
98 $SF_6$ - 1 $CCl_2F_2$ - 1 $CClF_2CF_3$
44 $SF_6$ - 55 $CCl_2F_2$ - 1 $CClF_2CF_3$.

Carbon formation was suppressed for compositions lying in regions rich in $SF_6$ defined by a line having at its extremities the points defined by 11 $SF_6$ - 88 $CCl_2F_2$ - 1 $CClF_2CF_3$
26 $SF_6$ - 1 $CCl_2F_2$ - 73 $CClF_2CF_3$.

EXAMPLE 31.

System $SF_6$-$CClF_3$-$CClF_2CF_3$

This system evidenced useful dielectric behavior within an area on a ternary diagram defined by a polygon having at its corners the points defined by 5 $SF_6$ - 85 $CClF_3$ - 10 $CClF_2CF_3$
27 $SF_6$ - 1 $CClF_3$ - 72 -$CClF_2CF_3$
98 $SF_6$ - 1 $CClF_3$ - 1 $CClF_2CF_3$
14 $SF_6$ - 85 $CClF_3$ - 1 $CClF_2CF_3$.

There was a synergistic BDV effect within an area on the ternary diagram defined by a polygon having at its corners the points defined by 30 $SF_6$ - 15 $CClF_3$ - 55 $CClF_2CF_3$
30 $SF_6$ - 1 $CClF_3$ - 69 $CClF_2CF_3$
98 $SF_6$ - 1 $CClF_3$ - 1 $CClF_2CF_3$
84 $SF_6$ - 15 $CClF_3$ - 1 $CClF_2CF_3$.

Carbon formation was suppressed for compositions lying in regions rich in $SF_6$ defined by a line having at its extremities the points defined by 1 $SF_6$ - 95 $CClF_3$ - 4 $CClF_2CF_3$
27 $SF_6$ - 1 $CClF_3$ - 72 $CClF_2CF_3$.

EXAMPLE 32.

System $SF_6$-$CBrF_3$-$CClF_2CClF_2$

This system evidenced useful dielectric behavior within an area on a ternary diagram defined by a polygon having at its corners the points defined by 14 $SF_6$ - 85 $CBrF_3$ - 1 $CClF_2CClF_2$
45 $SF_6$ - 1 $CBrF_3$ - 54 $CClF_2CClF_2$
98 $SF_6$ - 1 $CBrF_3$ - 1 $CClF_2CClF_2$.

Carbon formation was suppressed for compositions lying in regions rich in $SF_6$ defined by a line having at its extremities the points defined by 14 $SF_6$ - 85 $CBrF_3$ - 1 $CClF_2CClF_2$
45 $SF_6$ - 1 $CBrF_3$ - 54 $CClF_2CClF_2$.

EXAMPLE 33.

System $CO_2$-$CBrF_3$-$CClF_2CClF_2$

This system evidenced useful dielectric behavior within an area on a ternary diagram defined by a polygon having at its corners the points defined by 15 $CO_2$ - 84 $CBrF_3$ - 1 $CClF_2CClF_2$
45 $CO_2$ - 1 $CBrF_3$ - 54 $CClF_2CClF_2$
85 $CO_2$ - 1 $CBrF_3$ - 14 $CClF_2CClF_2$
50 $CO_2$ - 49 $CBrF_3$ - 1 $CClF_2CClF_2$.

Carbon formation was suppressed for compositions lying in regions rich in $CO_2$ and defined by a line having at is extremities the points defined by 15 $CO_2$ - 84 $CBrF_3$ - 1 $CClF_2CClF_2$
45 $CO_2$ - 1 $CBrF_3$ - 54 $CClF_2CClF_2$.

EXAMPLE 34.

Figure 10:
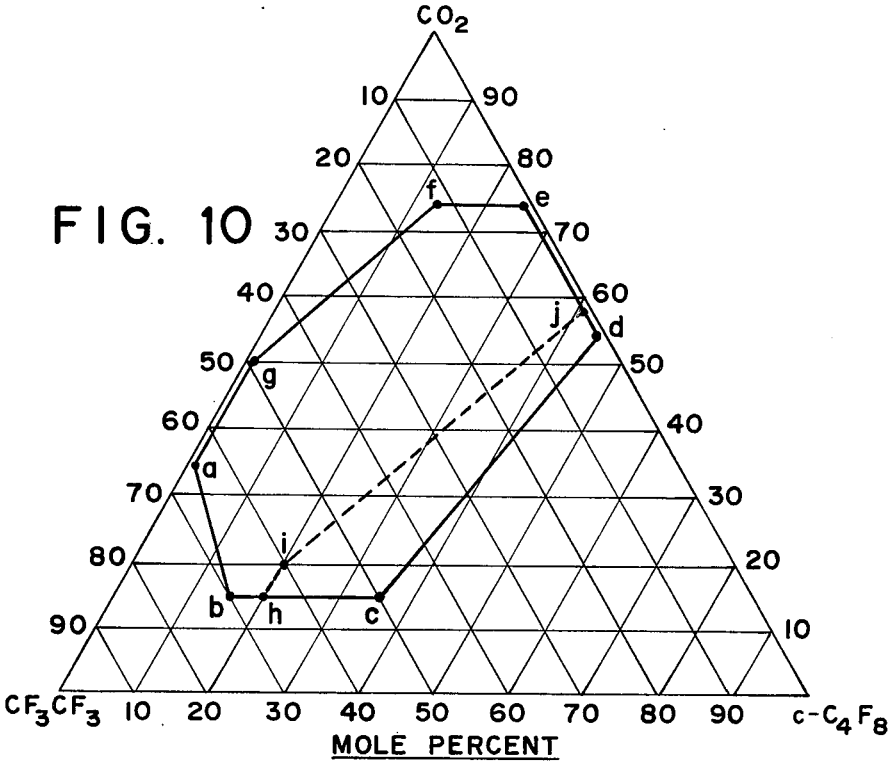
FIG. 10, on coordinates of concentration in mole percent, is a ternary plot of the system $CO_2$-$CF_3CF_3$-c-$C_4F_8$, showing useful regions of carbon formation suppression and improved dielectric strength.

System $CO_2$-$CF_3CF_3$-c-$C_4F_8$ (FIG. 10)

This system evidenced useful dielectric behavior within an area on a ternary diagram defined by a polygon a-b-c-d-e-f-g-a having at its corners the points defined by a. 35 $CO_2$ - 64 $CF_3CF_3$ - 1 c-$C_4F_8$
b. 15 $CO_2$ - 70 $CF_3CF_3$ - 15 c-$C_4F_8$
c. 15 $CO_2$ - 50 $CF_3CF_3$ - 35 c-$C_4F_8$
d. 55 $CO_2$ - 1 $CF_3CF_3$ - 44 c-$C_4F_8$
e. 75 $CO_2$ - 1 $CF_3CF_3$ - 24 c-$C_4F_8$
f. 75 $CO_2$ - 15 $CF_3CF_3$ - 10 c-$C_4F_8$
g. 50 $CO_2$ - 49 $CF_3CF_3$ - 1 c-$C_4F_8$.

There was a synergistic BDV effect with an area on the ternary diagram defined by a polygon h-c-d-j-i-h having at its corners the points defined by h. 15 $CO_2$ - 65 $CF_3CF_3$ - 20 c-$C_4F_8$
c. 15 $CO_2$ - 50 $CF_3CF_3$ - 35 c-$C_4F_8$
d. 55 $CO_2$ - 1 $CF_3CF_3$ - 44 c-$C_4F_8$
j. 58 $CO_2$ - 1 $CF_3CF_3$ - 41 c-$C_4F_8$
i. 20 $CO_2$ - 60 $CF_3CF_3$ - 20 c-$C_4F_8$.

Carbon formation was suppressed for compositions lying in regions rich in $CO_2$ defined by three lines, a-b, b-c and c-d, having at their extremities the points defined by 1. a. 35 $CO_2$ - 64 $CF_3CF_3$ - 1 c-$C_4F_8$
b. 15 $CO_2$ - 70 $CF_3CF_3$ - 15 c-$C_4F_8$
2. b. 15 $CO_2$ - 70 $CF_3CF_3$ - 15 c-$C_4F_8$
c. 15 $CO_2$ - 50 $CF_3CF_3$ - 35 c-$C_4F_8$
3. c. 15 $CO_2$ - 50 $CF_3CF_3$ - 35 c-$C_4F_8$
d. 55 $CO_2$ - 1 $CF_3CF_3$ - 44 c-$C_4F_8$.

EXAMPLE 35.

System $CO_2$-$CCl_2F_2$-$CHClF_2$

This system evidenced useful dielectric behavior within an area on a ternary diagram defined by a polygon having at its corners the points defined by 50 $CO_2$ - 1 $CCl_2F_2$ - 49 $CHClF_2$
25 $CO_2$ - 45 $CCl_2F_2$ - 30 $CHClF_2$
20 $CO_2$ - 79 $CCl_2F_2$ - 1 $CHClF_2$
75 $CO_2$ - 24 $CCl_2F_2$ - 1 $CHClF_2$
64 $CO_2$ - 1 $CCl_2F_2$ - 35 $CHClF_2$.

Carbon formation was suppressed for compositions lying in regions rich in $CO_2$ and defined by two lines having at their extremities the points defined by 1. 50 $CO_2$ - 1 $CCl_2F_2$ - 49 $CHClF_2$
25 $CO_2$ - 45 $CCl_2F_2$ - 30 $CHClF_2$
2. 25 $CO_2$ - 45 $CCl_2F_2$ - 30 $CHClF_2$
20 $CO_2$ - 79 $CCl_2F_2$ - 1 $CHClF_2$.

This system is an inexpensive gaseous dielectric mixture which, under a pressure of 1.5 atm, gives a dielectric strength approximately equal to $SF_6$ at 1 atm.

EXAMPLE 36.

System 90 $SF_6$-10 $CO_2$-$CCl_2F_2$-$CClF_2CF_3$

This quaternary system, in which $SF_6$ and $CO_2$ were held in a constant ratio of 90/10, evidenced useful dielectric behavior within an area on a ternary diagram of $SF_6$-$CO_2$, $CCl_2F_2$ and $CClF_2CF_3$ defined by a polygon having at its corners the points defined by 10 $SF_6$-$CO_2$ - 89 $CCl_2F_2$ - 1 $CClF_2CF_3$
30 $SF_6$-$CO_2$ - 1 $CCl_2F_2$ - 69 $CClF_2CF_3$
98 $SF_6$-$CO_2$ - 1 $CCl_2F_2$ - 1 $CClF_2CF_3$.

There was a synergistic BDV effect within an area on the ternary diagram defined by a polygon having at its corners the points defined by 40 $SF_6$-$CO_2$ - 30 $CCl_2F_2$ - 30 $CClF_2CF_3$
30 $SF_6$-$CO_2$ - 1 $CCl_2F_2$ - 69 $CClF_2CF_3$
98 $SF_6$-$CO_2$ - 1 $CCl_2F_2$ - 1 $CClF_2CF_3$
69 $SF_6$-$CO_2$ - 30 $CCl_2F_2$ - 1 $CClF_2CF_3$.

Carbon formation was suppressed for compositions lying in regions rich in $SF_6$-$CO_2$ defined by a line having at its extremities the points defined by 10 $SF_6$-$CO_2$ - 89 $CCl_2F_2$ - 1 $CClF_2CF_3$
30 $SF_6$-$CO_2$ - 1 $CCl_2F_2$ - 69 $CClF_2CF_3$.

What is claimed is:

1. A process for suppressing carbon formation in a dielectric fluid during an electrical discharge from an electrical conductor which comprises contacting the electrical conductor during operation with a gaseous dielectric mixture consisting essentially of at least one halogenated alkane plus one member selected from the group consisting of $CO_2$, in an amount of at least 15 mole percent, and a combination of $SF_6$ and $CO_2$ which, when plotted on a ternary diagram in mole percent of $SF_6$-$CO_2$-halogenated alkane, lies in regions rich in $SF_6$ and $CO_2$ defined by a line having at its extremities the points defined by 1 $SF_6$ - 15 $CO_2$ - 84 halogenated alkane
10 $SF_6$ - 1 $CO_2$ - 89 halogenated alkane, said halogenated alkane containing from 1 to 4 carbon atoms and at most one hydrogen atom, with the remaining hydrogen atoms replaced by at least one halogen selected from the group consisting of fluorine, chlorine and bromine, and having a vapor pressure of at least about 100 torr at 20° C.

2. The process of claim 1 in which the halogenated alkane has a vapor pressure of at least about 400 Torr at 20° C.

3. The process of claim 1 in which the halogenated alkane is totally gaseous at room temperature and has a boiling point of less than about 5° C.

4. The process of claim 1 in which the halogenated alkane consists essentially of at least one compound selected from the group consisting of $CHClF_2$, $CHF_3$, $CCl_3F$, $CCl_2F_2$, $CClF_3$, $CBrF_3$, $CClF_2CClF_2$, $CClF_2CF_3$, $CF_3CF_3$ and c-$C_4F_8$.

5. The process of claim 4 in which the gaseous dielectric mixture consists essentially of at least one halogenated alkane selected from the group consisting of $CF_3CF_3$, $CHClF_2$, $CCl_2F_2$ and $CClF_2CF_3$ plus at least about 15 mole percent of $CO_2$.

6. The process of claim 5 in which the gaseous dielectric mixture consists essentially of $CCl_2F_2$ and about 15 to 65 mole percent of $CO_2$.

7. The process of claim 5 in which the gaseous dielectric mixture consists essentially of $CClF_2CF_3$ and about 25 to 70 mole percent of $CO_2$.

8. The process of claim 4 in which the gaseous dielectric mixture consists essentially of at least one halogneated alkane selected from the group consisting of $CCl_2F_2$, $CHClF_2$, $CBrF_3$, $CCl_2FCClF_2$, $CClF_2CClF_2$ and $CClF_2CF_3$ plus both $SF_6$ and $CO_2$, the composition of the gaseous dielectric mixture, when plotted on a ternary diagram, lying in regions rich in $SF_6$ and $CO_2$ defined by a line having at its extremities the points defined by 1 $SF_6$ - 15 $CO_2$ - 84 halogenated alkane
10 $SF_6$ - 1 $CO_2$ - 89 halogenated alkane.

9. The process of claim 8 in which the gaseous dielectric mixture consists essentially of $CCl_2F_2$, $SF_6$ and $CO_2$, the composition of the gaseous dielectric mixture being defined by the area enclosed by the polygon a-b-c-d-e-a in FIG. 4 of the attached drawings.

10. The process of claim 8 in which the gaseous dielectric mixture consists essentially of $CClF_2CClF_2$, $SF_6$ and $CO_2$, the composition of the gaseous dielectric mixture being defined by the area enclosed by the polygon a-b-c-d-e-a in FIG. 7 of the attached drawings.

11. The process of claim 8 in which the gaseous dielectric mixture consists essentially of $CClF_2CF_3$, $SF_6$ and $CO_2$, the composition of the gaseous dielectric mixture being defined by the area enclosed by the polygon a-b-c-d-e-a in FIG. 8 of the attached drawings.

12. The process of claim 5 in which the gaseous dielectric mixture consists essentially of $CF_3CF_3$ and about 35 to 50 mole percent of $CO_2$.

13. A process for suppressing carbon formation in a dielectric fluid during an electrical discharge from an electrical conductor which comprises contacting the electrical conductor during operation with a gaseous dielectric mixture consisting essentially of at least one halogenated alkane selected from the group consisting of $CCl_2F_2$, $CHClF_2$, $CBrF_3$, $CClF_2CClF_2$ and $CClF_2CF_3$ plus one member selected from the group consisting of $CO_2$, in an amount of at least 15 mole percent, and a combination of $SF_6$ and $CO_2$ which, when plotted on a ternary diagram in mole percent of $SF_6$ - $CO_2$-halogenated alkane, lies in regions rich in $SF_6$ and $CO_2$ defined by a line having at its extremities the points defined by 1 $SF_6$ - 15 $CO_2$ - 84 halogenated alkane
10 $SF_6$ - 1 $CO_2$ - 89 halogenated alkane, said gaseous dielectric mixture evidencing improved dielectric strength.

14. A process for suppressing carbon formation in a dielectric fluid during an electrical discharge from an electrical conductor which comprises contacting the electrical conductor during operation with a gaseous dielectric mixture consisting of a mixture selected from the group consisting of a. 40 to 80 mole percent of $SF_6$, balance $CCl_2F_2$;
b. 75 to 85 mole percent of $SF_6$, balance $CClF_3$;
c. 60 to 85 mole percent of $SF_6$, balance $CBrF_3$;
d. 40 to 50 mole percent of $SF_6$, balance $CHClF_2$;
e. 25 to 90 mole percent of $SF_6$, balance $CClF_2CF_3$;
f. a composition within an area on a ternary diagram defined by a polygon having at its corners the points defined by
   45 $SF_6$ - 5 $CHF_3$ - 50 $CHClF_2$
   49 $SF_6$ - 1 $CHF_3$ - 50 $CHCF_2$
   98 $SF_6$ - 1 $CHF_3$ - 1 $CHClF_2$
   94 $SF_6$ - 5 $CHF_3$ - 1 $CHClF_2$;
g. a composition within an area on a ternary diagram defined by a polygon having at its corners the points defined by
   30 $SF_6$ - 55 $CCl_2F_2$ - 15 $CClF_2CF_3$
   30 $SF_6$ - 1 $CCl_2F_2$ - 69 $CClF_2CF_3$
   98 $SF_6$ - 1 $CCL_2F_2$ - 1 $CClF_2CF_3$
   44 $SF_6$ - 55 $CCl_2F_2$ - 1 $CClF_2CF_3$; and
h. a composition within an area on a ternary diagram defined by a polygon having at its corners the points defined by
   30 $SF_6$ - 15 $CClF_3$ - 55 $CClF_2CF_3$
   30 $SF_6$ - 1 $CClF_3$ - 69 $CClF_2CF_3$
   98 $SF_6$ - 1 $CClF_3$ - 1 $CClF_2CF_3$
   84 $SF_6$ - 15 $CClF_3$ - 1 $CClF_2CF_3$.

15. A carbon formation suppressant composition consisting essentially of at least one halogenated alkane plus both $SF_6$ and $CO_2$, said halogenated alkane containing from 1 to 4 carbon atoms and at most one hydrogen atom, with the remaining hydrogen atoms replaced by at least one halogen selected from the group consisting of fluorine, chlorine and bromine, and having a vapor pressure of at least about 100 Torr at 20° C, said composition, when plotted on a ternary diagram, lying in the regions rich in $SF_6$ and $CO_2$ defined by a line having at its extremities the points defined by 1 $SF_6$ - 15 $CO_2$ - 84 halogenated alkane
10 $SF_6$ - 1 $CO_2$ - 89 halogenated alkane.

16. The composition of claim 15 in which the vapor pressure of the halogenated alkane is at least about 400 Torr at 20° C.

17. The composition of claim 15 in which the vapor pressure of the halogenated alkane is totally gaseous at room temperature and has a boiling point of less than about 5° C.

18. The composition of claim 15 in which the halogenated alkane consists essentially of at least one compound selected from the group consisting of $CHClF_2$, $CHF_3$, $CCl_3F$, $CCl_2F_2$, $CClF_3$, $CBrF_3$, $CClF_2CClF_2$, $CClF_2CF_3$, $CF_3CF_3$ and c-$C_4F_8$.

19. The composition of claim 18 consisting essentially of $CCl_2F_2$, $SF_6$ and $CO_2$, the composition being defined by the area enclosed by the polygon a-b-c-d-e-a in FIG. 4 of the attached drawings.

20. The composition of claim 18 consisting essentially of $CHClF_2$, $SF_6$ and $CO_2$, the composition being defined by the area enclosed by the polygon a-b-c-d-e-a in FIG. 5 of the attached drawings.

21. The composition of claim 18 consisting essentially of $CBrF_3$, $SF_6$ and $CO_2$, the composition being defined by the area enclosed by the polygon a-b-c-d-e-a in FIG. 6 of the attached drawings.

22. The composition of claim 18 consisting essentially of $CClF_2CClF_2$, $SF_6$ and $CO_2$, the composition being defined by the area enclosed by the polygon a-b-c-d-e-a in FIG. 7 of the attached drawings.

23. The composition of claim 18 consisting essentially of $CClF_2CF_3$, $SF_6$ and $CO_2$, the composition being defined by the area enclosed by the polygon a-b-c-d-e-a in FIG. 8 of the attached drawings.

24. The composition of claim 18 having improved dielectric strength, in which the halogenated alkane consists essentially of at least one compound selected from the group consisting of $CCl_2F_2$, $CHClF_2$, $CBrF_3$, $CClF_2CClF_2$ and $CClF_2CF_3$.

25. The composition of claim 24 consisting essentially of $CCl_2F_2$, $SF_6$ and $CO_2$, the composition being defined by the area enclosed by the polygon f-g-d-h-f in FIG. 4 of the attached drawings.

26. The composition of claim 24 consisting essentially of $CHClF_2$, $SF_6$ and $CO_2$, the composition being defined by the area enclosed by the polygon c-d-f-c in FIG. 5 of the attached drawings.

27. The composition of claim 24 consisting essentially of $CBrF_3$, $SF_6$ and $CO_2$, the composition being defined by the area enclosed by the polygon f-g-h-c-f in FIG. 6 of the attached drawings.

28. The composition of claim 24 consisting essentially of $CClF_2CClF_2$, $SF_6$ and $CO_2$, the composition being defined by the area enclosed by the polygon f-c-d-g-f in FIG. 7 of the attached drawings.

29. The composition of claim 24 consisting essentially of $CClF_2CF_3$, $SF_6$ and $CO_2$, the composition being defined by the area enclosed by the polygon f-c-d-g-f in FIG. 8 of the attached drawings.

* * * * *

UNITED STATES PATENT AND TRADEMARK OFFICE

CERTIFICATE OF CORRECTION

PATENT NO. : 4,071,461

DATED : January 31, 1978

INVENTOR(S) : Whitney H. Mears & Sabatino R. Orfeo

It is certified that error appears in the above-identified patent and that said Letters Patent are hereby corrected as shown below:

Column 2, line 31, "tracing" should read -- tracking --.

Column 5, line 27, "includes" should read -- include --.

Column 22, line 35, "torr" should read -- Torr --.

Column 24, line 66, "f-g-h-c-f" should read -- f-g-h-d-f --.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*